US010731420B2

(12) United States Patent
Dahlgren et al.

(10) Patent No.: US 10,731,420 B2
(45) Date of Patent: Aug. 4, 2020

(54) INDEXING DRILL BIT

(71) Applicant: Schlumberger Technology Corporation, Sugar Land, TX (US)

(72) Inventors: Scott S. Dahlgren, Alpine, UT (US); David R. Hall, Provo, UT (US); Joshua J. Hanson, Arlington, VA (US); Jonathan D. Marshall, Springville, UT (US); John J. Pierce, Fort Worth, TX (US); Yuelin Shen, Spring, TX (US); Balasubramanian Durairajan, Sugar Land, TX (US); Geoffrey Charles Downton, Stonehouse (GB); Michael George Azar, The Woodlands, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/562,934

(22) PCT Filed: Mar. 27, 2016

(86) PCT No.: PCT/US2016/024397
§ 371 (c)(1),
(2) Date: Sep. 29, 2017

(87) PCT Pub. No.: WO2016/160637
PCT Pub. Date: Oct. 6, 2016

(65) Prior Publication Data

US 2018/0087323 A1 Mar. 29, 2018

Related U.S. Application Data

(60) Provisional application No. 62/139,948, filed on Mar. 30, 2015.

(51) Int. Cl.
*E21B 10/43* (2006.01)
*E21B 10/08* (2006.01)
(Continued)

(52) U.S. Cl.
CPC ..... *E21B 10/43* (2013.01); *E21B 10/08* (2013.01); *E21B 10/20* (2013.01); *E21B 23/004* (2013.01)

(58) Field of Classification Search
CPC ..... E21B 10/55; E21B 10/573; E21B 10/567; E21B 2010/622; E21B 2010/624;
(Continued)

(56) References Cited

U.S. PATENT DOCUMENTS 1,320,384 A * 11/1919 Godbold et al. ..... E21B 10/20 175/315
1,885,266 A * 11/1932 Johnson ..... E21B 10/20 175/346

(Continued)

FOREIGN PATENT DOCUMENTS

CN 1069548 A 3/1993
CN 1795318 A 6/2006
WO 2010144837 A2 12/2010

OTHER PUBLICATIONS

International Search Report and Written Opinion issued in International Patent Application No. PCT/US2016/024397 dated Jul. 29, 2016, 13 pages.

(Continued)

*Primary Examiner* — Jennifer H Gay

(57) ABSTRACT

A drill bit may include a bit body and at least two cones assemblies including at least two drive cylinders having at least two cones. The at least two cone assemblies are mounted on the bit body. The drill bit may also include an indexing mechanism coupled to the bit body and configured
(Continued)

to rotate and lock at least one drive cylinder. A method of operating the drill bit may include providing fluid to the drill bit, rotating the drill string to drill formation, moving the indexing mechanism an axial distance within a central chamber of the drill bit, rotating the at least two indexable structures as the indexing mechanism moves, and locking the at least two indexable structures.

19 Claims, 25 Drawing Sheets

(51) Int. Cl.
*E21B 23/00* (2006.01)
*E21B 10/20* (2006.01)

(58) Field of Classification Search
CPC ..... E21B 10/62; E21B 10/43; E21B 10/20; E21B 23/004; E21B 10/006; E21B 10/08; B23B 2260/004
See application file for complete search history.

(56) References Cited

U.S. PATENT DOCUMENTS 3,369,618 A * 2/1968 Moore ..... E21B 4/04 175/104
3,847,236 A * 11/1974 Coalson ..... E21B 10/20 175/257
3,963,365 A * 6/1976 Shallenberger, Jr. ..... B23B 27/1662 408/186
4,101,239 A * 7/1978 Wohlhaupter .... B23B 29/03407 407/37
4,194,862 A * 3/1980 Zweekly ..... B23B 51/0493 408/224
5,645,323 A * 7/1997 Beach ..... E21B 10/12 299/111
6,484,819 B1 * 11/2002 Harrison ..... E21B 7/064 166/66
6,880,437 B2 * 4/2005 Sjoo ..... B23B 29/043 407/101
8,061,452 B2 * 11/2011 Cooley ..... B23B 27/12 175/383
8,480,338 B2 * 7/2013 Meyer ..... B23B 51/048 408/224
8,506,212 B2 * 8/2013 Meyer ..... B23B 51/048 408/224
8,950,516 B2 * 2/2015 Newman ..... E21B 10/62 175/383
9,574,407 B2 * 2/2017 Clark ..... E21B 10/43
9,643,259 B2 * 5/2017 Meyer ..... B23B 51/048
9,739,097 B2 * 8/2017 Zhang ..... E21B 10/573
2005/0183893 A1 * 8/2005 Sjogren ..... B22F 5/003 175/426
2007/0079991 A1 * 4/2007 Cooley ..... B23B 27/12 175/57
2008/0304925 A1 * 12/2008 Meyer ..... B23B 51/048 408/204
2009/0020339 A1 * 1/2009 Sherwood, Jr. ..... E21B 10/43 175/426
2011/0088955 A1 * 4/2011 Cooley ..... B23B 27/12 175/428
2011/0112480 A1 5/2011 Brustad
2012/0273280 A1 * 11/2012 Zhang ..... E21B 10/573 175/428
2012/0312599 A1 * 12/2012 Trinh ..... E21B 10/43 175/57
2013/0068525 A1 * 3/2013 DiGiovanni ..... E21B 47/01 175/40
2013/0098688 A1 * 4/2013 Yong ..... E21B 10/22 175/227
2013/0112480 A1 5/2013 Newman
2013/0287512 A1 * 10/2013 Meyer ..... B23B 51/048 408/186
2015/0047905 A1 * 2/2015 Clark ..... E21B 10/43 175/57
2015/0129310 A1 5/2015 Newman
2015/0337603 A1 * 11/2015 Schroder ..... B23P 11/02 175/336
2018/0087323 A1 * 3/2018 Dahlgren ..... E21B 23/004

OTHER PUBLICATIONS

International Preliminary Report on Patentability issued in International Patent Application No. PCT/US2016/024397 dated Oct. 12, 2017, 10 pages.
First Office Action issued in Chinese Patent Application No. 201680023518.4, dated Nov. 2, 2018, 8 pages. English translation not available.

* cited by examiner

INDEXING DRILL BIT

CROSS-REFERENCE TO RELATED APPLICATIONS

This application claims the benefit of, and priority to, U.S. Provisional Patent Application Ser. No. 62/139,948, filed on Mar. 30, 2015, which application is expressly incorporated herein by this reference in its entirety.

BACKGROUND

Drill bits used to drill wellbores through geological formations generally fall within one of two broad categories of bit structures: "roller cone" bits and "fixed cutter" or "drag" drill bits. Roller cone bits include one or more roller cones rotationally mounted to the bit body. During operation, the roller cones will rotate with respect to the drillstring to drill a wellbore in a geological formation. A drag drill bit has a body formed from steel or another high strength material, and cutting elements (sometimes referred to as cutter elements, cutters, or inserts) attached at selected positions to the bit body. The cutting elements are located on a plurality of blades. Unlike the cones of the roller cone bit, the blades of the drag bit are stationary with respect to the drill string. The drag drill bit relies on rotation of the drillstring to cut through a geological formation.

As the blades of the drag bit are stationary with respect to the drill string, the same cutting elements are exposed to the geological formation during drilling. The cutting elements may include diamond impregnated in the blade or bit (on the bits known as diamond impregnated bits) or may be formed having a cylindrical substrate or support stud made of carbide, for example, tungsten carbide, and an ultra-hard cutting surface layer made of polycrystalline diamond material or a polycrystalline boron nitride material deposited or otherwise bonded to the substrate (on bits referred to as PDC bits).

SUMMARY

In one aspect, embodiments of the present disclosure are directed to a drill bit. The drill bit includes a bit body. At least two cones assemblies including at least two drive cylinders having at least two cones mounted thereon may be mounted on the bit body. The drill bit may also include an indexing mechanism on the bit body configured to rotate and lock at least one drive cylinder.

In another aspect, embodiments of the present disclosure are directed to a bit. The bit has a bit body and at least two indexable structures having a plurality of cutting elements. The bit may include an indexing mechanism on the bit body, such that the indexing mechanism is configured to engage and rotate the at least two indexable structures and engage at least one of the at least two indexable structures.

In yet another aspect, embodiments of the present disclosure are directed to a method of drilling a wellbore. The method includes rotating a drill string having a drill bit at a distal end thereof, thereby drilling formation. The drill bit includes at least two indexable structures and an indexing mechanism in a first position. The indexing mechanism may be moved an axial distance within a central chamber of the drill bit. The movement of the indexing mechanism may thereby rotate the at least two indexable structures as the indexing mechanism moves. The indexable structures may then be locked.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

In one aspect, embodiments disclosed herein relate to drag bits having indexing cutting elements (herein referred to as indexing bits or indexing drill bits). Indexing cutting elements or indexable structures refers to at least one cone, roller, wheel, or similar structure having cutting elements positioned thereon that is indexable with respect to the drill string. The indexing cutting elements may be rotatable to discrete positions with respect to the drill string or bit body, and in some embodiments, the cones may not be able to rotate freely when at an indexed position. During operation (e.g., drilling or reaming the formation, milling casing or downhole components, etc.) the indexing cutting elements may be in a first, fixed position, allowing a portion of cutting elements positioned thereon to engage the formation or other workpiece. The indexing cutting element may then cut in a fixed position relative to the drill string or bit body. After a predetermined or set amount of time, once the cutting elements are worn, after a predetermined or set distance, or after any desired variable has been achieved, the indexing cutting elements may be indexed to expose a different portion of cutting elements, or different cutting elements, to perform the cutting operation. In other words, indexing the bit rotates the cone to allow different cutting elements or different parts of the cutting elements, to engage the workpiece. After indexing the bit, the indexable structures are fixed again. Although bits are described herein as "drill bits," the term is not limited to bits used to drill formation, and is intended to encompass mills, reamers, or other downhole cutting tools.

Due to the abrasive nature of the contact between the cutting elements and the formation or other workpiece being cut, extreme temperatures, forces, and pressures encountered in subterranean environments, the cutting elements may wear away quickly. As wear occurs, the cutting element becomes increasingly ineffective until it does not effectively penetrate the workpiece. In order to replace the worn cutting elements, the drill string could be pulled up to the surface. This maintenance increases operating costs due to increased tool downtime and usage of replacement parts and maintenance labor. In one aspect, embodiments of the present disclosure provide the ability to index the cutting structure and present new or different cutting elements while the tool remains downhole.

Indexable Cones

Figure 1:
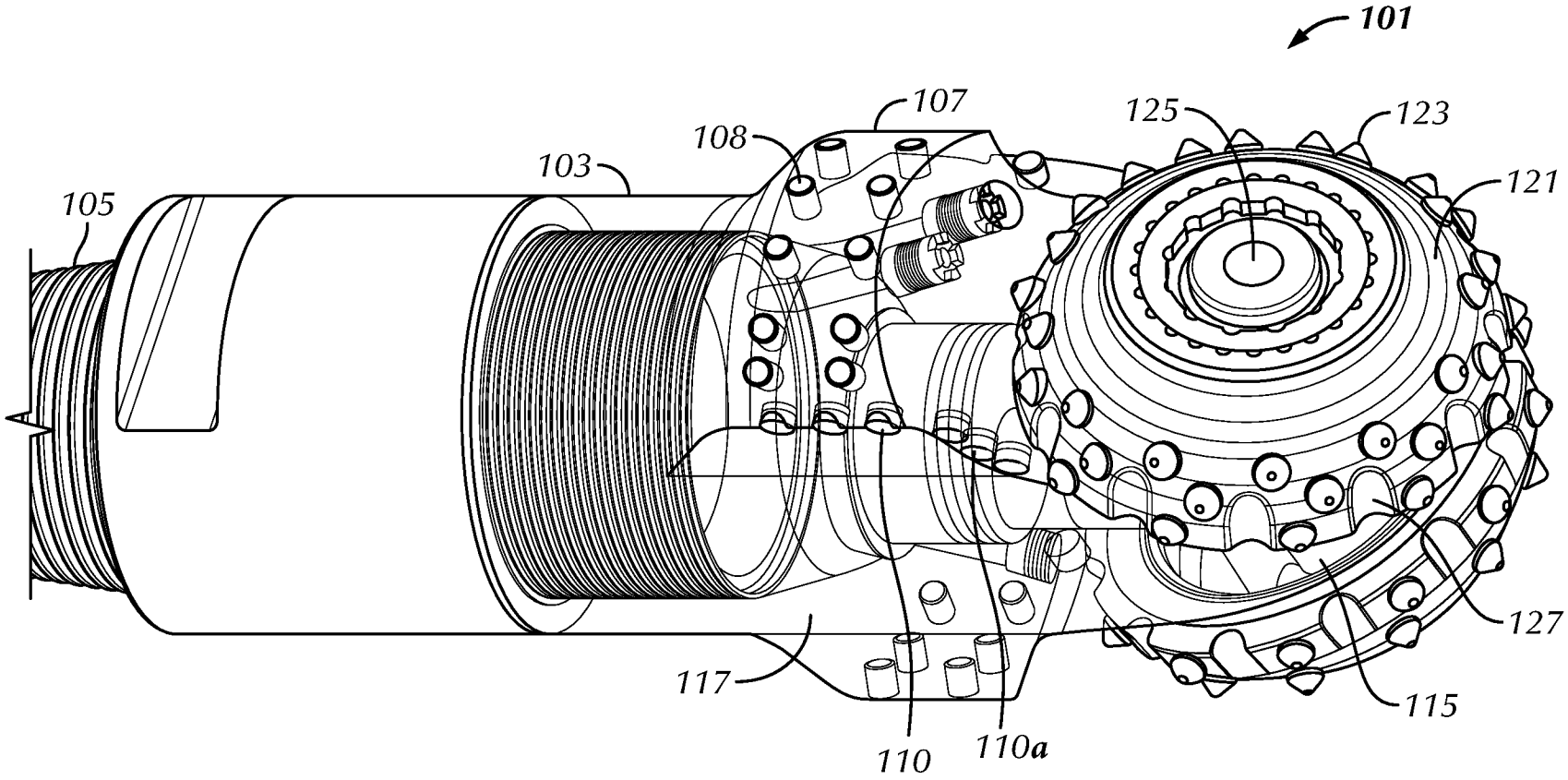
FIGS. 1 and 2 are perspective views of a drill bit according to embodiments of the present disclosure.
Figure 2:
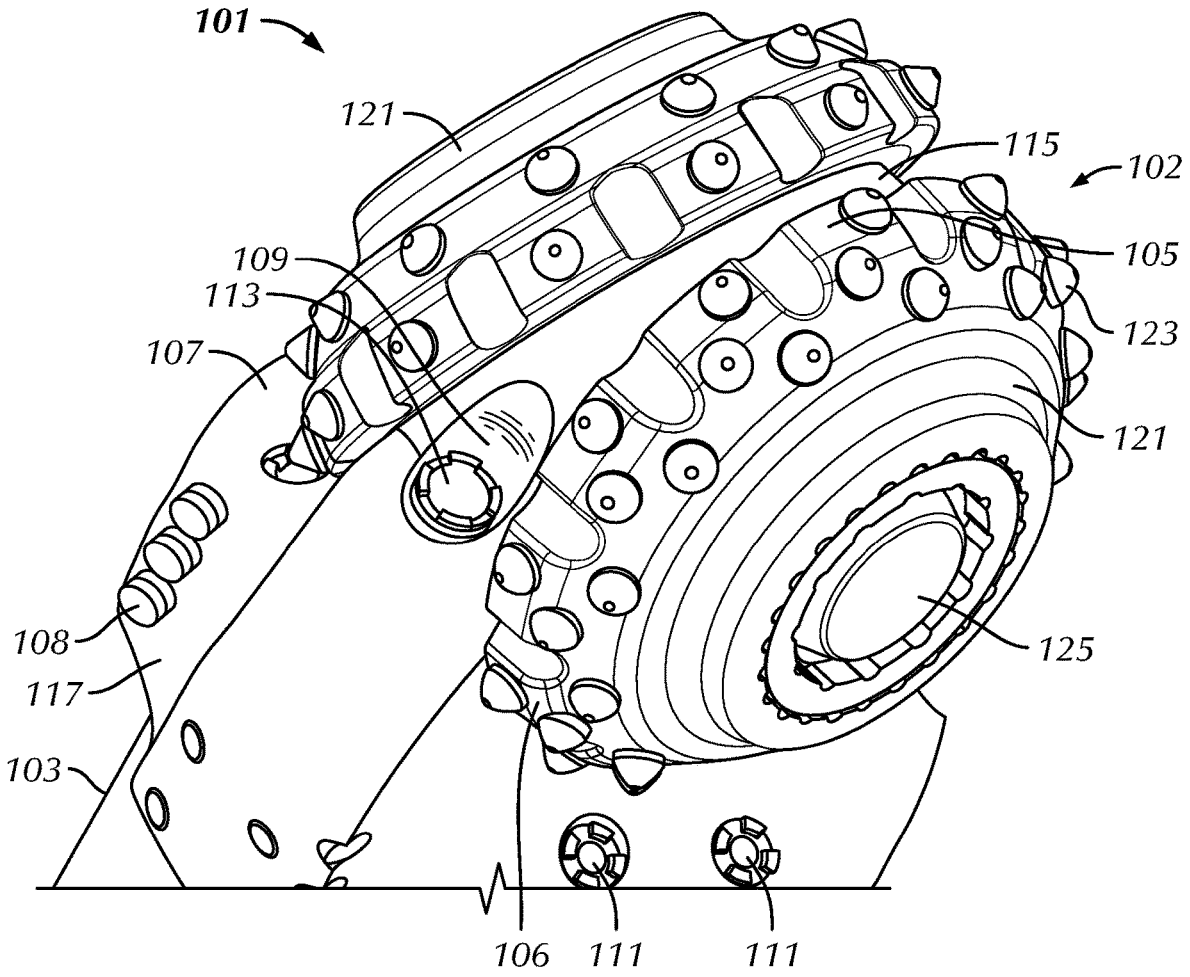
Figure 3:
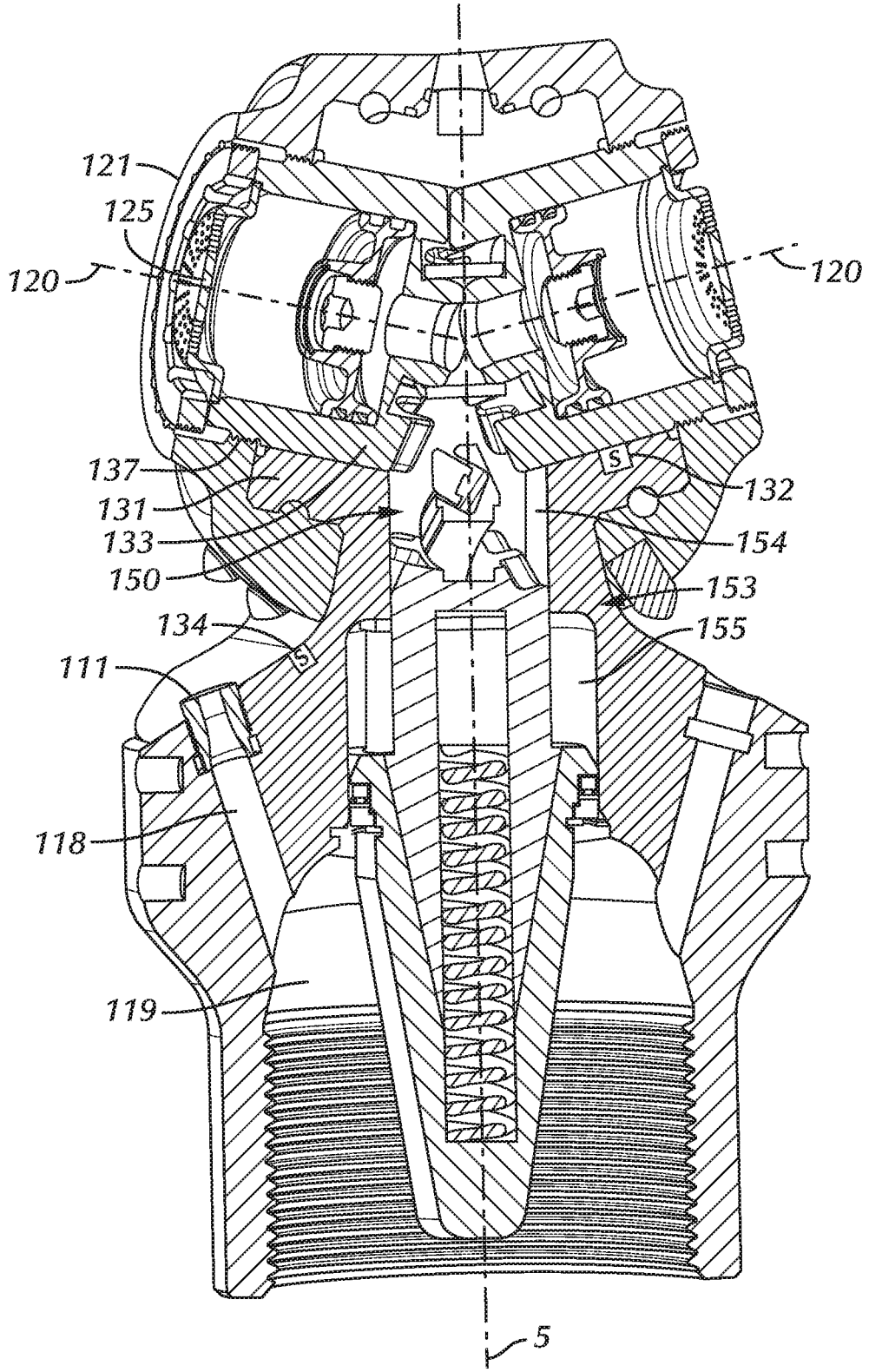
FIG. 3 is a cross-sectional view of a drill bit according to embodiments of the present disclosure.

FIGS. 1 and 2 show views of an indexing drill bit according to embodiments of the present disclosure and FIG. 3 shows a cross sectional view of an indexing bit according to embodiments of the present disclosure. As shown in FIG. 1, an indexing drill bit 101 includes a bit body 103 having at a proximal end, a threaded pin end 105 for coupling bit 101 to a drill string. The cutting end of the bit body 103, opposite the threaded pin end 105, may include at least two journals 131 fixed to the bit body 103 (e.g., integrally formed with the bit body), where each journal receives a cone assembly including cone 121 and drive cylinder 133. According to some embodiments, the journals may be formed separately from the bit body 103 and fixed (e.g., welded or mechanically coupled) to the bit body 103. As used herein, the terms "proximal" and "distal" are used to indicate that a component or feature is located toward an up-hole end or a downhole end of a drill string, respectively.

A cone 121 having a plurality of cutting elements 123 may be rotationally mounted to each journal. The cutting elements may include a variety of shapes, for example, but not limited to, chisel, conical, bowed or flat slant crested, semi-round top, ridge shaped, multiple cornered cutters (e.g., four, eight, ten, or twelve cornered cutters), or any other cutting element shapes known in the art. In some embodiments, a multiple cornered cutter (e.g., a corner with a plurality of edges) may be used that has the same number of corners or edges as the number of times the indexing bit is configured to index. In some embodiments, an ultrahard cutter, such as a polycrystalline diamond compact may be used. In other embodiments, a carbide cutting element or any element suitably used in milling operations may be used. As the cone 121 rotates, a different edge or side of a cutting element 123 may be exposed or a new cutting element may be exposed and another cutting element hidden.

The cones 121 may have a variety of profiles (i.e., an outline of a cross-sectional view taken through a central axis of the cone), including, but not limited to a convex profile with a uniform radius of curvature, a convex profile with a varying radius of curvature, or a profile having both a convex and concave portion. In some embodiments, the cones may be the same size, while in other embodiments, at least one cone may be larger than the other cones. In some embodiments, each cone may have a different size. In some embodiments, each cone may have a different center hole coverage (e.g., a single cone may cover the center of the hole). The cutting elements 123 may be arranged on each cone in rows, for example, as illustrated in FIG. 2, one cone 121 includes three rows of cutting elements 123 and the other cone 121 includes two rows of cutting elements 123. Any arrangement and shape of cutting elements and cone profiles may be used.

In some embodiments, the cones may be generally circular in cross-sectional shape; however, any suitable shape may be used. For example, the cone may be circular, elliptical, polygonal, or have an undulating profile. For non-circular cone shapes, indexing the cone may cause a diameter of the bit 101 to change. For example, an elliptical shaped cone will have a major (long) and minor (short) axis. When the major axis of the cone is perpendicular to the bit axis 5, the diameter of the bit 101 will be larger than when a minor axis of the cone is perpendicular to the bit axis 5. In some embodiments, a circularly shaped cone may be installed off-center, which would also allow a diameter of the bit 101 to change when the cone is indexed. As used herein, the term "installed off-center" is used to describe a cone that is attached to a drill bit at a location other than a center point of the cone. In some embodiments, off-center installation may be used to expand a wellbore diameter (e.g., to ream the wellbore).

The cones may be mounted at an angle relative to each other. That is, the cones may be oriented at a "cone angle" that is measured by taking the angle between the longitudinal axis of a cone (120 in FIG. 3) and the axis 5 of the bit 101. According to some embodiments, the cones 121 may be positioned orthogonal to the axis 5 (i.e., each at a cone angle of 90°. In some embodiments, the cone angle of one or more (and potentially each cone 121) may be in a range of about 15°-120°, and in some embodiments, the cone angle may be in the range of 45°-85°, 55°-80°, or 60°-75°. For example, the cone angle of each cone 121 may be 64°. In some embodiments, each cone may have the same cone angle, while in other embodiments, at least one cone may have a different cone angle than one or more of the other cones.

The cones may be spaced apart around the bit axis by a cone separation angle (i.e., the minimum angle between two adjacent cone axes projected on a horizontal plane that is perpendicular to the axis of the bit 5). For instance, two cones evenly spaced apart around the bit axis will be spaced apart at an angle of 180° (i.e., have cone separation angle of 180° and three cones evenly spaced apart around the bit axis will be spaced apart at an angle of 120°. In other embodiments, however, the two or more cones may not be evenly spaced apart. For instance, two cones may have a cone separation angle of 170°. In some embodiments, two cones may have a separation angle of 140° to 180°, 150° to 170°, or 160°. In three-cone embodiments, two cones may have a cone separation angle of 100° to 140°, 110° to 130°, or 120°.

One or more of the cones may have a cone offset, where the axis of the cone is angled slightly away from the drill bit axis 5. Cone offset can be determined by viewing the drill bit from the bottom on a horizontal plane that is perpendicular to the bit axis 5. A positive offset is defined by an angle with the direction of rotation of the drill bit. A negative offset is defined by an angle against the direction of rotation of the drill bit. The amount of cone offset is measured by the minimum distance between the drill bit axis 5 and the cone axis 120 when projected on the horizontal plane. In some embodiments, each cone may have a positive offset, while in other embodiments a combination of positive offset, negative offset, or no offset may be used. In some embodiments, each cone may have a negative offset. For example, in the bit shown in FIG. 3, a first cone may have a positive cone offset and a second cone may have a negative cone offset. The amount of cone offset is may be expressed in relation to the diameter of the drill bit. For example, in some embodiments, a cone offset may be 1/32 inch per inch (or 1/32 mm per mm) of bit diameter. However, the amount of cone offset may vary.

Each cone may have a plurality of rows of cutting elements 123 and each cone may have an outer diameter having indentations 127 (e.g. radiused indentations) between cutting elements 123 on the row having the largest diameter for the cone 121 and optionally the indentations may extend between cutting elements 123 of the outermost row and the adjacent row. However, any suitable cutter layout may be used, and any number or design of indentations may be used.

During drilling operations, each cone 121 may engage the formation along an arc length 102 of the cone 121. The arc length 102 of a cone 12 may refer to a portion of the cone 121 extending from the distal point 105 of the cone 121 to the last point that will engage a geological formation during drilling 106 along the cone 121 diameter. Depending on the geometry of the cone, a different percentage of the total circumference of the cone 121 will engage the formation. For example, as illustrated in FIGS. 1-3, approximately 50% of the circumference of the cone 121 may engage the formation. A filter 125 may be located proximate the center of the cone 121. The filter may prevent large cuttings and debris from entering the cone 121 and bit body 103.

Referring to FIG. 3, the bit body may further include a central chamber 119 including a piston chamber 153 having a distal piston chamber 154 and a proximal piston chamber 155. The central chamber 119 may be in fluid communication with a central bore of the drill string. Thus, fluid, for example, drilling fluid, may be provided to the central chamber 119 through the drill string. At least a portion of the piston chamber 153 may be sealed from the central chamber 119 using, for example, an O-ring, or other sealing mechanisms known in the art. The piston chamber 153 may contain a fluid, for example, air and/or incompressible fluids such as oil. According to some embodiments, the piston chamber 153 may not be aligned with a central axis 5 (i.e., an axis that runs longitudinally through the center of the drill bit 101). According to other embodiments, the piston chamber may be aligned with a central axis 5.

The bit body 103 may further include a plurality of nozzles 111, 113 located in a plurality of recesses 109 formed in the bit body 103. The nozzles 111, 113 may be included to direct drilling fluid from the drill string to outside the drill bit 101 to cool the cones 121, cutting elements 123, and clean the drill cuttings from the work area. The bit body 103 may include a primary nozzle 113, and at least one secondary nozzle 111. The primary nozzle 113 may be larger than secondary nozzle 111. The primary nozzle 113 may provide fluid at a greater pressure and/or velocity than secondary nozzles 111. As shown in FIGS. 1 and 2, the primary nozzle 113 may direct fluid downhole toward the distal end of the drill bit 101, between the cones 121. The configuration of the two cones 121 may form a hydraulic channel 115. The drilling fluid may then continue along hydraulic channel 115 traveling toward a proximal end of the drill bit 101 to clean away cuttings. Fluid from the secondary nozzles 111 may be directed toward the distal end of the drill bit 101 over cones 121 and enter the hydraulic channel 115, where it may travel toward a proximal end of the drill bit 101.

Fluid may be provided to the nozzle 111, 113 through central chamber 119, as shown in FIG. 3. As noted above, central chamber 119 may be in fluid communication with a central bore of the drill string and may provide fluid to nozzles 111 through nozzle passages 118. Nozzles may be individually oriented based on the desired hydraulic function(s) (e.g., cutting element cleaning, cone cleaning, bottom hole cleaning, cuttings evacuation, cutting element cooling, etc.). In some embodiments, the primary nozzle 113 may be replaced with at least two secondary nozzles 111. Any suitable nozzle configuration may be used.

The bit body 103 may also include at least one gauge pad 107 to help maintain gage and reduce damage to hydraulic components. The gauge pad 107 may include a plurality of inserts 108 on the outer surface thereof and a plurality of cutters 110 at or near a gage on a leading face thereof to wear away the formation and maintain gauge. The bit may also include one or more under-gage cutters 110*a* along the leading edge of the bit body (e.g., on a portion of the body at the transition between the gage pad and the bit body) that is adjacent to the gage 107. Under-gage cutters 110*a* may trim uncut formation if inserts 123 at the gage of the cones that are designed to cut the gage wear, or if ledges in the borehole are present. Gaps 117 may be present between gauge pads 107 to allow movement and flow of drilling fluid and cuttings up-hole. According to some embodiments, gauge pads 107 may be positioned symmetrically about the bit body 103. According to other embodiments, the gauge pads 107 may not be positioned symmetrically about the bit. For example, as seen in FIG. 1, gauge pads 107 may be spaced to form a gap 117 proximate hydraulic channel 115. This gap 117 may be wider than a gap or gaps 117 located on the opposite side of bit body 103, where less fluid flow is expected.

As shown in FIG. 3, indexing drill bit 101 may further include a drive cylinder 133 coupled to each cone 121 to form a cone assembly. The drive cylinder 133 may be coupled with, for example, a threaded connection 137; however, the drive cylinder 133 may be coupled to cone 121 using any suitable method(s) (e.g., welds, rivets, a press fit, integral/unitary formation, etc.).

Figure 4:
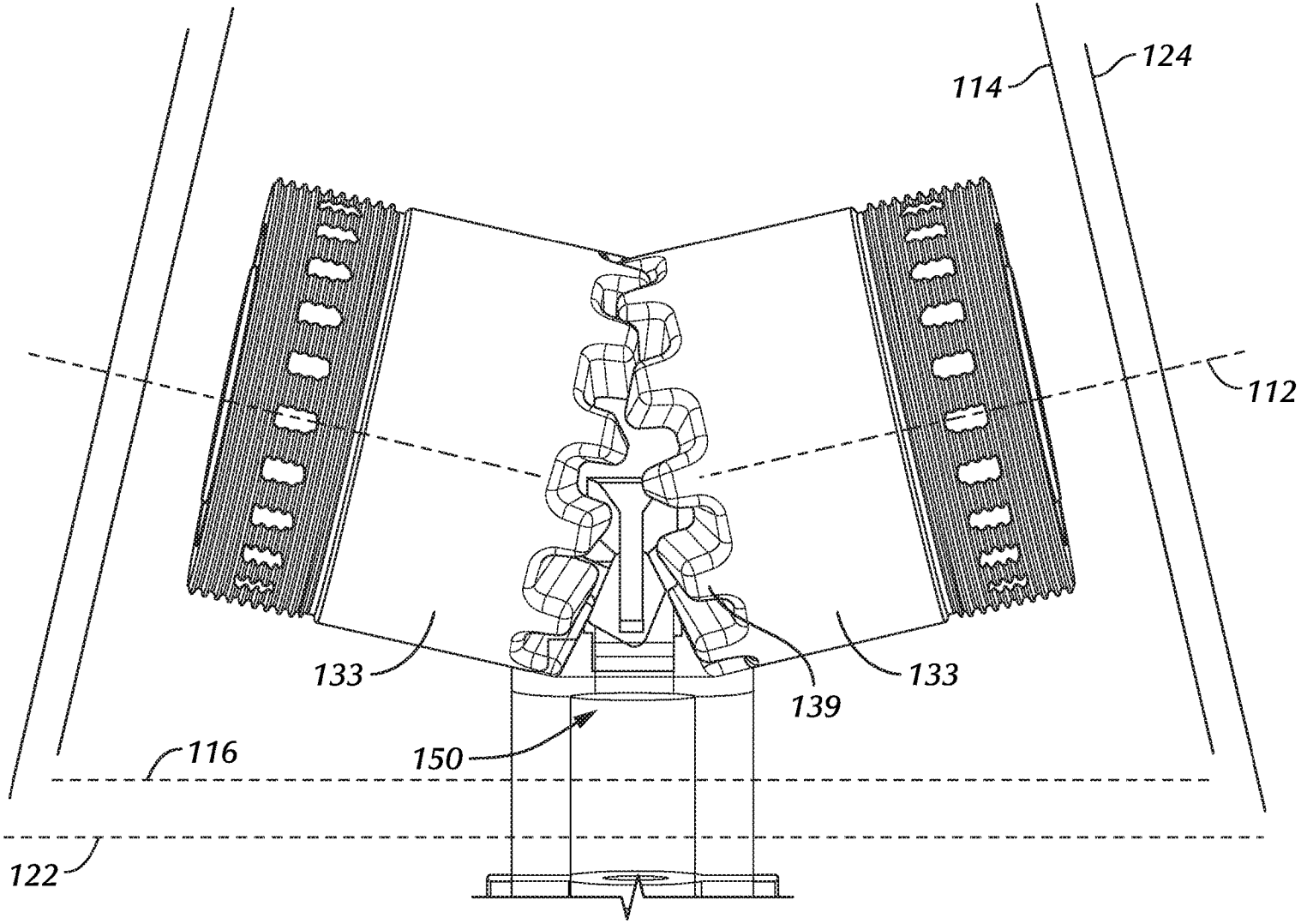
FIG. 4 shows an indexing mechanism according to embodiments of the present disclosure.

FIG. 4 shows two interlocked drive cylinders 133 in accordance with embodiments of the present disclosure. A plurality of teeth 139 may be located on at least a portion of an end of each drive cylinder 133. The spacing of the teeth 139 may be about 15° apart; however, any suitable teeth spacing may be used. For example, the spacing of the teeth 139 may be about 5°-60°. The angle of the drive cylinders 133 may allow the teeth 139 of the adjacent drive cylinders to be engaged. As shown in FIGS. 3 and 4, the drive cylinders 133 may interlock at an angle that corresponds to the cone angle. For example, at least one tooth 139 of a first drive cylinder 133 may engage at least two teeth 139 of a second drive cylinder 133.

With the teeth 139 engaged, imparting rotational motion to a first drive cylinder 133 will drive (i.e., cause) rotation of the second drive cylinder 133. As the cones 121 are coupled to the drive cylinders 133, rotation of the drive cylinders 133 will cause a corresponding cone 121 to rotate. Thus, when this disclosure refers to rotating the drive cylinder 133, it is implied that cones 121 are rotated as well and vice-versa, unless otherwise indicated. According to some embodiments, more than two drive cylinders 133 may be located on a drill bit 101. In such an embodiment, imparting rotational motion to a first drive cylinder 133 may drive rotation of the remaining drive cylinders 133.

Figure 24:
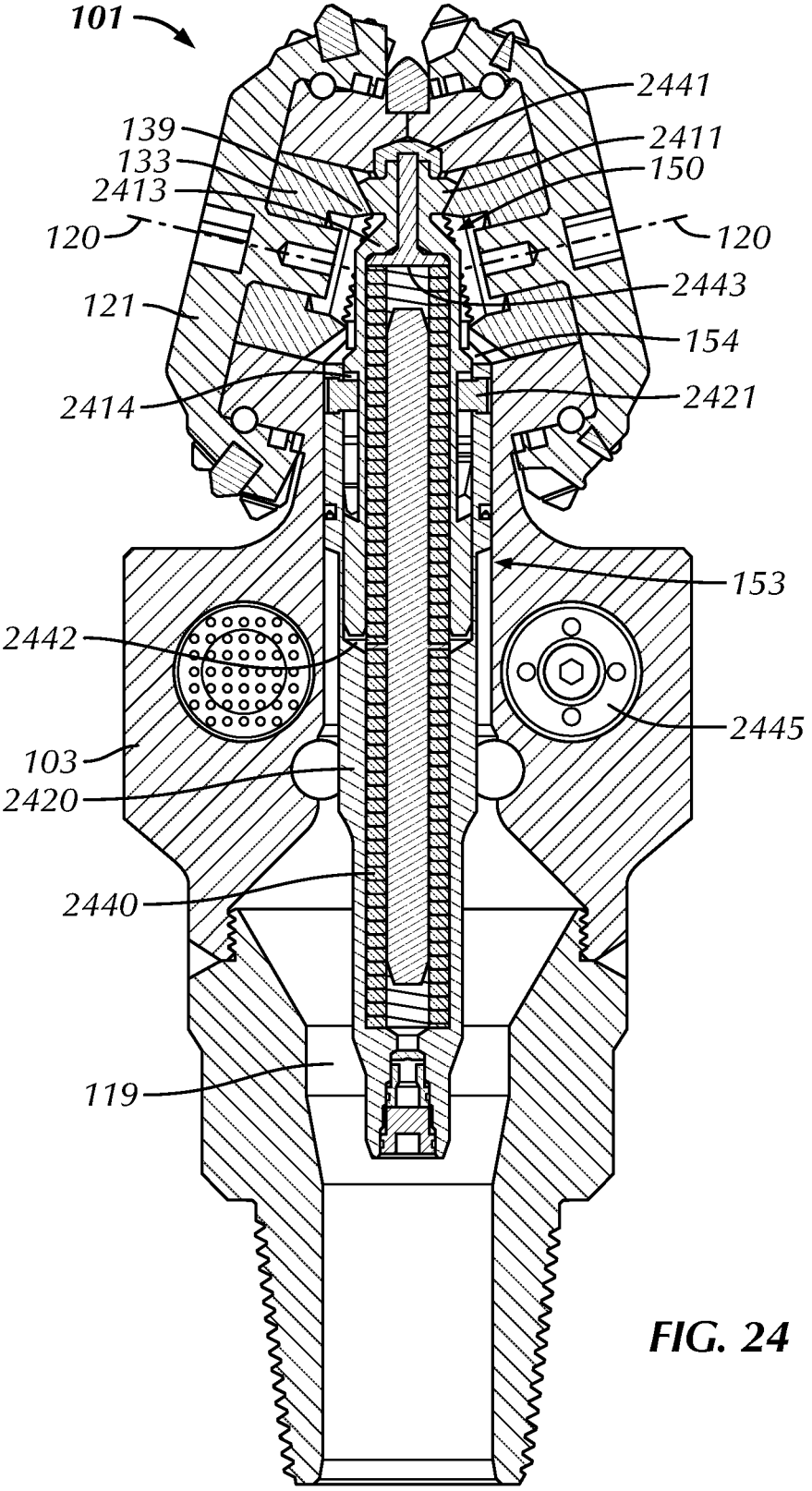
FIG. 24 is a cross-sectional view of a drill bit according to embodiments of the present disclosure.
Figure 25:
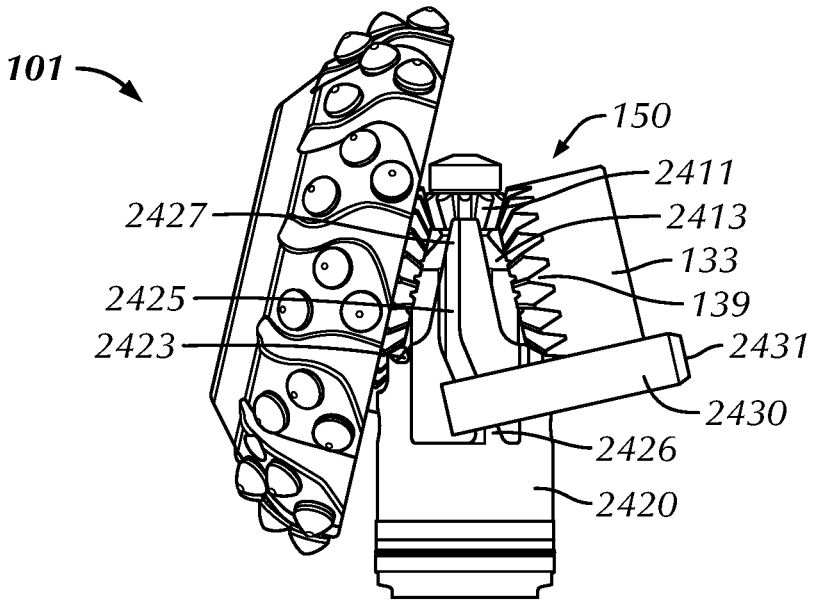
FIG. 25 shows a locking mechanism according to embodiments of the present disclosure.

Referring to FIG. 24, the drive cylinders 133 may not be interlocked. In this embodiment, each drive cylinder 133 is rotated individually to index the corresponding cone. The drive cylinders 133 may each engage an indexing mechanism 150 to drive the rotation. Referring to FIG. 25, the plurality of teeth 139 of each drive cylinder 133 may have a substantially serrated profile, in other words, the teeth 139 may have a triangular cross-section. The profile of the teeth 139 of the drive cylinders 133 may be any suitable profile, and the profile of the various embodiments described may be used in other embodiments. For example, the drive cylinder 133 geometry described with respect to FIG. 4 may be used in embodiments having non-interlocked drive cylinders 133 and vice-versa. Additionally, any suitable number and configuration of drive cylinders 133 may be used.

Referring again to FIG. 3, an indexing mechanism 150 is shown. The indexing mechanism is provided on the body 103 to both index and lock the drive cylinders 133. The indexing mechanism may be located in the piston chamber 153. According to some embodiments, an integrated indexing mechanism 150 may both index and lock the drive cylinder. According to some other embodiments, an indexing mechanism 150 may include a dedicated indexing component and a dedicated locking component.

Indexing the drive cylinder may expose unused and/or lightly used cutting elements to a subterranean formation during drilling and move worn cutting elements out of contact with a formation. In some embodiments, indexing the drive cylinder may expose different portions of the same cutting element to the formation. In some embodiments, indexing may expose a different type of cutting element for drilling a section of a formation with different geological properties than an initial section. For instance, a conical diamond element may be used for drilling a first section, while a conical diamond element having convex sides may be used for drilling a second section. In some embodiments, tungsten carbide or other milling elements may be exposed (e.g., to mill out a portion of casing, a plug, or other downhole component), and the bit may then be indexed to expose conical or other cutting elements to cut formation. According to some embodiments, the indexing may be performed by rotating the drive cylinder 133 a discrete or predetermined radial distance, for example, by at least one tooth 139. Locking the driving cylinders 133 prevents rotational movement of the cones 121 during drilling. Extraneous rotational movement of the cones 121 may result in ineffective cutting and over-torqueing the cones 121 and drive cylinders 133, which could cause damage to the drill bit 101.

Figure 20:
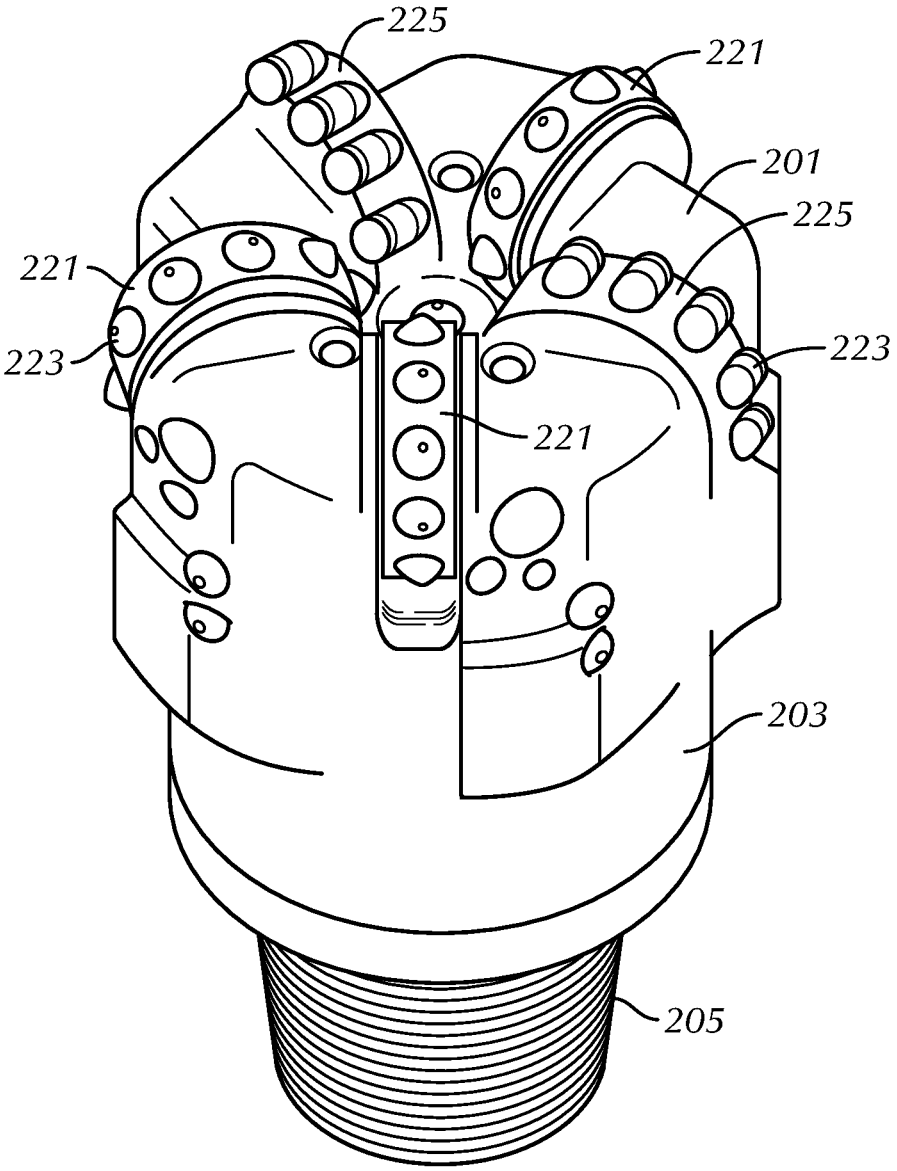
FIG. 20 is a perspective view of a drill bit according to embodiments of the present disclosure.

In some embodiments, the indexing bit may be configured to rotate the cones a set portion of their circumference. For instance, the indexing bit may be configured to rotate the cones between about 5% and 50% of the total circumference (e.g., approximately 5%, 8.3%, 12.5%, 16.7%, 25%, 33.3%, 40%, or 50% of the circumference). In some embodiments, there may be between 2 and 20 steps or indexes to rotate the cones completely (e.g., 12 steps or indexes may completely rotate the cones). In some embodiments, the indexing bit may be configured to continue to index whenever the indexing mechanism is actuated. In other embodiments, the indexing bit may have an indexing lock to prevent further indexing after a certain number of indexes (e.g., the bit may have milling cutting elements exposed to be used initially as a mill, and then the cones may be indexed and rotated half way around to expose diamond elements for drilling formation and the bit then used as a drilling bit, where a locking mechanism prevents further indexing). Indexable Wheels Referring to FIGS. 20 and 21, a view of an indexing drill bit according to another embodiment of the present disclosure is shown. As shown in FIG. 20, an indexing drill bit 201 includes a bit body 203 having at a proximal end, a threaded pin end 205 for coupling bit 201 to a drill string. At the distal end of bit 201 is the cutting end. In particular, the cutting end of the bit body 203 may include at least one wheel 221. As used herein, a "wheel" refers to a disc like structure having cutting elements 223 located on a perimeter thereof. The axis of rotation of the wheels 221 may be substantially parallel to or substantially perpendicular to a longitudinal axis of the drill bit 201. At least a portion of the faces of the wheel 221 may be interfaced by the bit body 203 (particularly, each face may be interfaced by the bit body 203). In some embodiments, the bit may include a combination of wheels 221 and fixed blades 225, including at least one wheel 221 and at least one fixed blade 225. In some embodiments, the bit 201 may include up to, for example, six wheels 221. A variety of configurations of wheels 223 and fixed blades 225 may be used.

Figure 21:
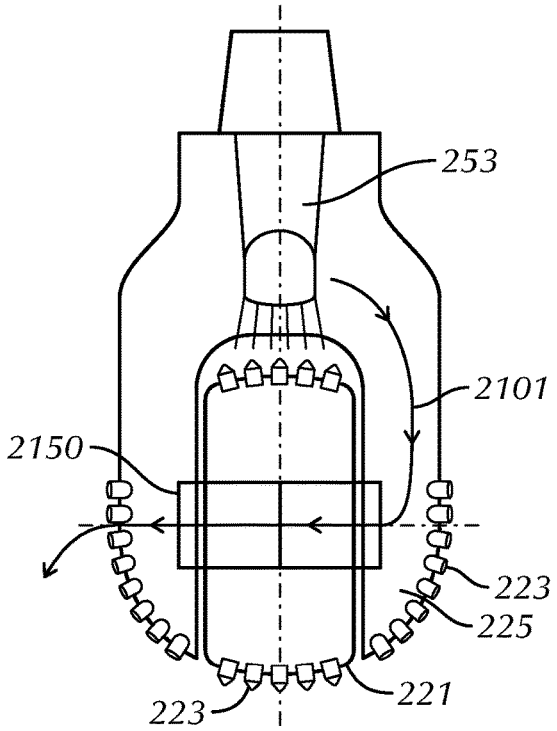
FIGS. 21 and 22 are cross-sectional views of a drill bit according to embodiments of the present disclosure.

The cutting elements 223 may include a variety of shapes at the cutting end of the cutting element, but not limited to, cylindrical bodied cutting elements (frequently referred to a polycrystalline diamond compact cutters or PDC cutters), or conical or other non-planar cutting ends extending to an apex including cutting ends having a convex or concave side surface that terminate in an apex, or cutting elements having a hyperbolic paraboloid or parabolic cylinder or any other cutting element shapes known in the art. For example, as illustrated in FIG. 21, the fixed blades include cylindrical cutting elements 223 (frequently referred to as cutters), while the wheel 221 includes conical shaped cutting elements 223. The wheels may have a generally circular profile, for example, the wheels may be circular, elliptical, polygonal, or have an undulating profile.

For wheel shapes that are not circular, indexing the wheel may cause a diameter of the bit 201 to change. For example, an elliptical shaped wheel will have a major (long) and minor (short) axis. When a cutter located proximate a wheel surface located tangent to the major axis engages the formation, the diameter of the bit 201 will be larger than when a cutter proximate a wheel surface located tangent to the minor axis engages the formation. In some embodiments, a circularly shaped wheel may be installed off-center, which would also allow a diameter of the bit 201 to change when the wheel is indexed. As used herein, the term "installed off-center" is used to describe a wheel that is attached to a drill bit at a location other than a center point of the wheel. FIG. 4 illustrates first wheels 114 installed to be centered with an axis 112 of the drive cylinders 133, thereby providing a first diameter 116 of the bit. Second wheels 124 installed to be off-center with the axis 112 of the drive cylinders 133 may provide a second diameter 122 of the bit that is different (e.g., greater than) the first diameter 116.

As described above with respect to the cones 121, indexing the wheels 221 may expose unused and/or lightly used cutting elements to a subterranean formation during drilling and move worn cutting elements out of contact with a formation. The indexing may be performed by rotating at least one wheel 221 a discrete radial distance, for example, by at least 30°. Locking the wheels 221 prevents rotational movement of the wheels 221 during drilling. Extraneous rotational movement of the cones 221 may result in ineffective cutting and over-torqueing the wheels 221, which could cause damage to the drill bit 101.

Indexing Mechanisms

Although the following indexing mechanisms are described with respect to a specific indexable structure, for example a cone 121 or wheel 221, one skilled in the art will understand that the following indexing mechanisms may be adapted for use with either cone 121 or wheel 221.

Gear and Indexing Track

Figure 26:
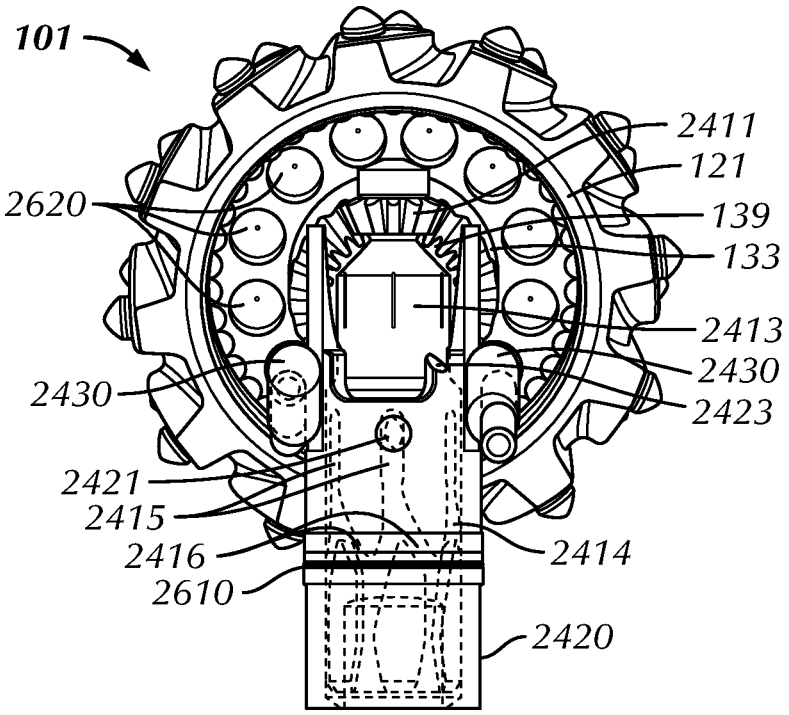
FIG. 26 shows an indexing mechanism according to embodiments of the present disclosure.

Referring to FIGS. 24-26, an indexing mechanism 150 according to embodiments of the present disclosure is shown. The indexing mechanism includes a an indexing cylinder 2413 having a gear 2411, for example, a pinion gear, coupled to a distal end of the indexing cylinder 2413 and a piston 2420 positioned proximal to the indexing cylinder 2413 such that a proximal end of the indexing cylinder is located in the piston 2420. In some embodiments, the gear 2411 and the indexing cylinder 2413 may be formed as a single integral piece. As shown in FIG. 24, the gear 2411 is positioned to engage the plurality of teeth 139 of both of the drive cylinders 133. Rotation of the indexing cylinder 2413 and hence the gear 2411 will result in rotation of the drive cylinder 133 and cone 121; however, any suitable gear 2411 and drive cylinders 133 configuration may be used. For example, each drive cylinder may include a corresponding gear 2411.

A spring 2440 may be positioned in a central cavity 2442 formed by the piston cylinder 2413 and the piston 2420. The spring 2440 may be a return spring to bias the piston 2420 toward a proximal end of the drill bit 101 in the absence of fluid flow. A cap 2441 may be located at a distal end of the indexing mechanism extending through the gear 2411. A proximal end 2443 of the cap 2441 may provide a surface a for the spring 2440 to act against such that the piston 2420 may move axially up and down relative to the indexing cylinder 2413, gear 2411, and the bit body 103. Compensation pistons 2445 may be included to provide oil to the spring 2440 and the piston 2420 to compensate for fluctuations oil volume caused by relative movement of the piston while indexing the cone assemblies. A seal, such as an O-ring 2610 may be used to isolate the central cavity from the piston chamber.

Referring to FIG. 26, the indexing cylinder 2413 includes an indexing channel 2414 positioned on an outer surface thereof. The indexing channel 2414 may be a continuous channel circumferentially located on the indexing cylinder 2413. In some embodiments, the indexing channel 2414 may include alternating cycles of substantially straight portions 2415 and angled portions 2416. As used herein, a cycle may "start" at a straight portion 2415 and move to an adjacent straight portion 2415 of the indexing channel 2414. The following cycle begins at an adjacent distal-most location of the indexing channel 2414.

Referring to FIGS. 24 and 26, the piston 2420 may include an indexing pin 2421. The indexing pin 2421 protrudes from an inner wall of the piston 2420 and engages the indexing channel 2414. As the piston 2420 strokes axially up and down, the indexing pin 2421 travels in the indexing channel 2414. The profile of the protruding portion (i.e., the portion that engages the indexing channel 2414) of the indexing pin 2421 may be a diamond shape. The angled contours of the diamond shape may help to maintain a constant torque as the indexing pin 2421 moves in the indexing channel 2414, as well as encouraging the pin 2421 to enter the next angled portion 2416 of the track instead of returning up the previously traveled angled track 2416. The geometry of the protruding portion may be any suitable shape, for example, circular, ovoid, square, rectangular, or the like.

The gear 2411 may lock the cones in place during operation. In the same or other embodiments, however, a locking mechanism 2430 is provided to lock the cones 121 during drilling operations, which may also reduce wear on the gear 2411. Referring to FIG. 25, at least one protruding track 2425 may be positioned at an upper end of the piston 2420. The at least one track protruding 2425 may include a substantially straight portion 2427 and an angled portion 2426. Referring to FIGS. 25 and 26, a locking mechanism 2430, for example a lock pin, may be provided to engage and travel along the protruding track 2425. The locking mechanism 2430 may include a groove to engage the protruding track 2425 for relative motion therebetween. During drilling operations, the locking mechanism 2430 engages and locks a corresponding cone 121 in place. Specifically, a distal end 2431 of the locking mechanism 2430 may engage one of a plurality of cavities 2620 located in the corresponding cone 121 to lock the cone 121. In some embodiments, the locking mechanism 2430 may be spring loaded.

The piston 2420 may include a locking surface 2423 to preload a corresponding drive cylinder 133 before engaging the locking mechanism 2430 with the corresponding cone 121. In some embodiments, at least one locking surface 2423 may be spring loaded, e.g., to accommodate tolerance stack-ups between the locking surface 2423 of the piston 2420 and the cone 133. Accordingly, each cone assembly may have a corresponding locking mechanism 2430 and locking surface 2423.

During drilling operations, the drill string may be rotated, thereby rotating the drill bit 101 located on a distal end thereof. The cone assemblies, including cones 121 and drive cylinders 133, may engage and drill a formation. During drilling, the cone assemblies may be locked to remain stationary with respect to the drill bit and the drill string. In other embodiments or depending on the type of formation being drilled, the cones may be unlocked and free to rotate during drilling.

After drilling for a predetermined or set amount of time, distance, or any other factor, or once it has been determined that the cutting element 123 engaging the formation are worn, or for any reason, the cone assemblies may be indexed to expose unused or lightly worn cutting element to the formation, to expose other portions of the cutting elements to the formation, or to rotate the cone to expose a different cutting structure. As the cone 121 rotates, a previously unexposed edge or face of the cutting element 123 may engage the formation. This may increase the fatigue life of the cutting elements, as the previously unexposed edge of the cutting element 123 may be sharper than a worn edge of the cutting element 123.

The cutting elements may be determined to be worn through any suitable means, e.g., by positioning a sensor downhole (in or near the cutting element or in or near the bit) to monitor the cutting elements 123, calculating how long it would take a cutting element to wear away in the relevant drilling conditions, and/or monitoring the progress of the drill string in the formation (i.e., if the drill string is not cutting the formation at an expected rate, it may be deduced that the cutting elements are worn). The sensor may monitor the wear of a portion of the cutting elements, for example, the wear of the cutting elements engaging with the formation during operation. Upon detection of worn cutting elements, the sensor may trigger a signal that causes or otherwise leads to actuation of the indexing mechanism to index the cones. In some embodiments, upon detection of worn cutting elements, an operator may manually actuate the indexing mechanism to index the cones.

Fluid is provided to the drill bit 101 during operation, as discussed above, causing the indexing mechanism to be positioned as shown in FIGS. 24-26. Specifically, the fluid flow increases the pressure within the central chamber 119 of the bit body 103, which applies force to the piston causing the spring 2440 to compress, as shown in FIG. 24. When the spring 2440 is compressed, the piston 2420 is urged toward a distal end of the bit body 103 and the indexing pin 2421 moves toward the start of the next cycle or adjacent straight segment 2415 as shown in FIG. 26.

Figure 28:
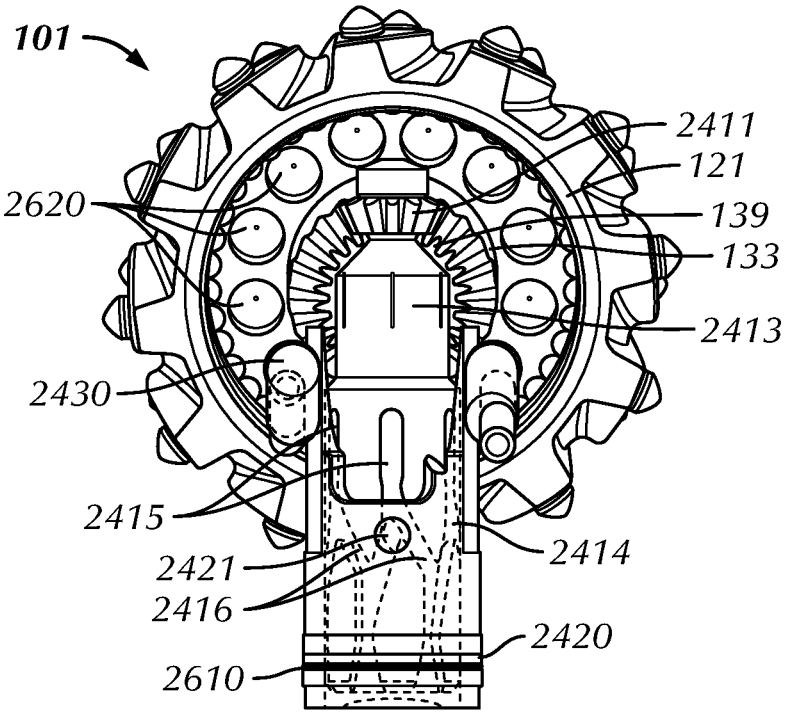
FIGS. 28 and 29 show an indexing mechanism according to embodiments of the present disclosure.

The cone assembly (e.g., drive cylinder 133 and cone 121) may be indexed by cycling the flow of fluid provided to the drill bit by decreasing the flow of fluid to the bit and subsequently increasing the fluid flow to the bit. As described above, when fluid flow is provided, the assembly is locked and the piston 2420 is at the distal end of the stroke. When the volume of fluid flow is decreased to a rate that allows the spring 2440 to expand, the piston 2420 will move axially toward a proximal end of the drill bit 101. Movement of the piston 2420 causes the indexing pin 2421 to move relative to the indexing channel 2414. As seen in FIGS. 26 and 28, as the piston 2420 and the indexing pin 2421 move proximally to the drill bit 101, the indexing pin 2421 moves from the substantially straight portion 2415 of the indexing channel 2414 to the angled portion 2416. Moving the indexing pin 2421 through the angled portion 2416 causes the indexing cylinder 2413 and the gear 2411 to rotate, thereby rotating and partially indexing the cone assembly.

Figure 27:
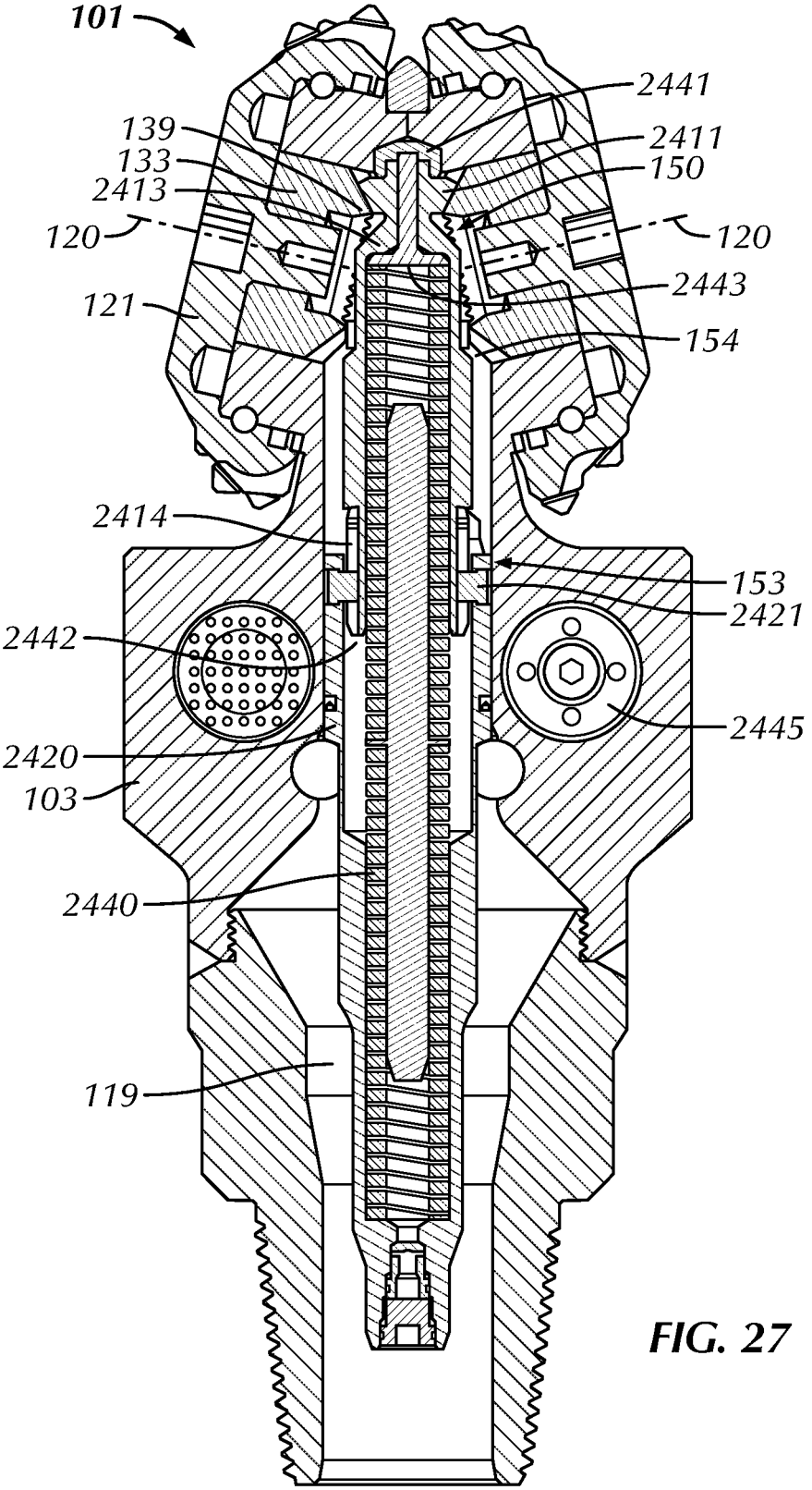
FIG. 27 is a cross-sectional view of a drill bit according to embodiments of the present disclosure.
Figure 29:
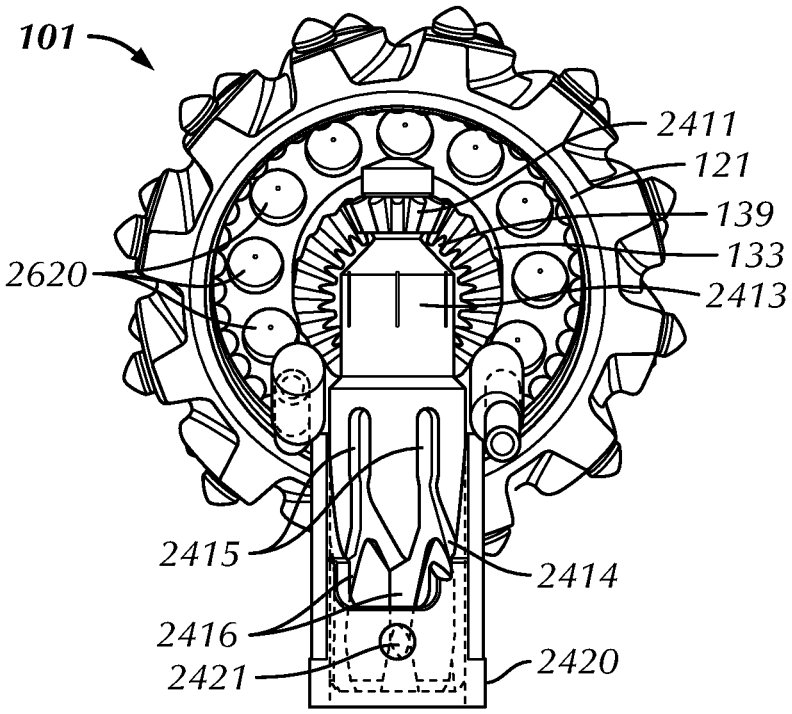

FIGS. 27 and 29 show the position of the indexing assembly when the spring 2440 is expanded under no or low fluid flow. As shown, the piston 2420 and the indexing pin 2421 are in respective proximal locations. From this position, and in order to have full indexing of the cones, fluid flow may be provided to the drill bit to compress the spring 2440 back to the position illustrated in FIG. 24. As the spring 2440 compresses, the piston 2420 and the indexing pin 2421 are pushed axially toward the distal end of the drill bit 101. In order to accommodate the axial movement of the indexing pin 2421 traveling in the indexing channel 2414, the indexing cylinder 2413 and gear 2411 rotate. The rotation of the gear 2411 causes the cone assembly to rotate, thereby indexing the cone assembly to the next position. Once indexed, the indexing mechanism will be in the position illustrated in FIGS. 24-26, where the spring 2440 is compressed, the piston 2420 is located at a distal end of the bit body 103, and the indexing pin 2421 is located at the distal end of a cycle.

In some embodiments, a hydraulic valve may be positioned to control the pressure on the piston 2420. The hydraulic valve may be electronically or otherwise controlled and actuated on command by an operator, e.g., when the bit is off the bottom of the borehole. This embodiment may further include a return piston to bring the indexing mechanism 150 to the start of a cycle. According to this embodiment, movement of the indexing pin 2421 may not be determined by fluid flow, but rather determined by an operator. This allows the indexing mechanism 150 to index the cones 121 consecutively, without affecting fluid flow. Indexing the cones 121 multiple times may be performed when a particular position of the cones 121, e.g., 120 or 180 degrees from a current position, is desired. A position sensor may be provided to indicate when the cones 121 have been indexed or are in a desired position. The position sensor may be configured to provide an indication of the position uphole, so that an operator is able to determine the indexing location.

Figure 30:
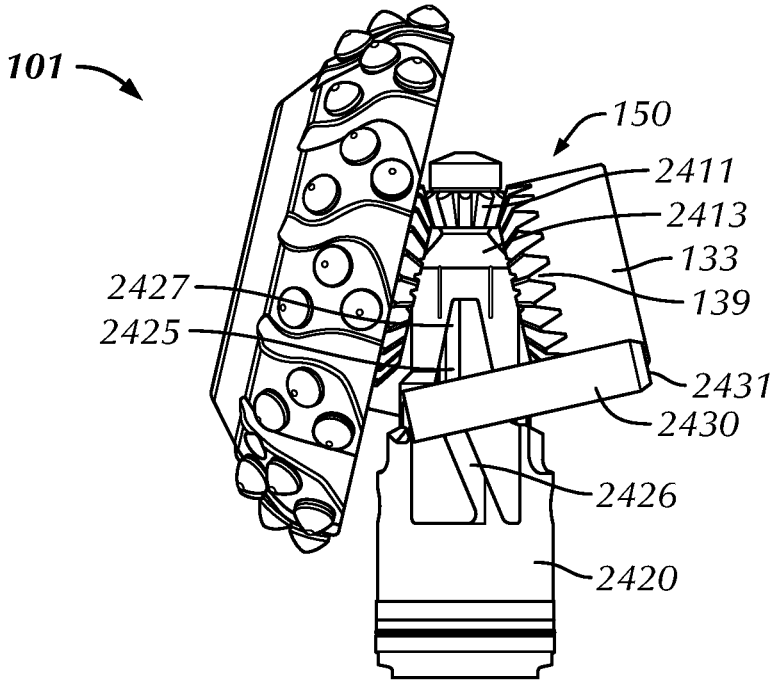
FIGS. 30 and 31 show a locking mechanism according to embodiments of the present disclosure.

In embodiments including the locking mechanism 2430, during drilling operations (i.e., in the presence of fluid flow), the locking mechanism 2430 is at the most proximal end of the protruding track 2425 as shown in FIGS. 25 and 26. In this position, the locking mechanism 2430 engages a cavity 2620 to lock the corresponding cone assembly in place. While the cone assembly is being indexed, the volume of fluid flow is decreased to a rate that allows the spring 2440 to expand. The piston 2420 moves axially toward a proximal end of the drill bit 101, thereby causing the locking mechanism 2430 to move along the protruding track 2425. As the locking mechanism 2430 moves along the angled portion 2426 of the protruding track 2425, the locking mechanism 2430 will disengage from the cavity (2620 in FIG. 26) in cone 121, as shown in FIG. 30.

Figure 31:
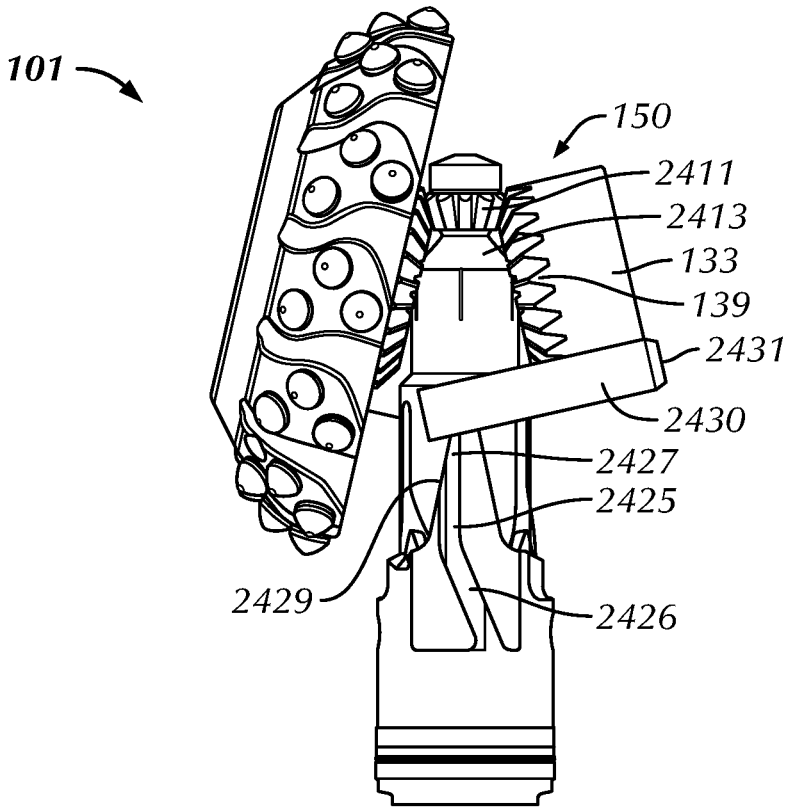

When the spring 2440 is fully expanded and the piston 2420 is in the proximal location shown in FIG. 27, the locking mechanism 2430 will be at the distal end of the protruding track 2425, as illustrated in FIGS. 31 and 29. In some embodiments, locking mechanism 2430 may be spring loaded for partially engaging the corresponding cone 121 when the locking mechanism 2430 is at the distal end of the protruding track 2425. As used herein, the phrase "partially engage" is used to mean that the locking mechanism 2430 contacts the cone 121, for example in a space between cavities 2620, but does not engage the cavity 2620. Partially engaging the locking mechanism 2430 with the corresponding cone 121 may reduce extraneous movement or "jitter" of the cone while the spring is expanded. Partially engaging the locking mechanism 2430 may also prevent damage to the indexing mechanism 150, by mitigating torque that may be transferred to the indexing mechanism during periods of low flow.

As discussed above, fluid flow is increased to complete indexing the cone assembly. The increased fluid flow compresses spring 2440 and moves piston 2420 toward a distal end of the drill bit 101, thereby causing the locking mechanism 2430 to move along the protruding track 2425 toward a proximal end of the track. When the locking mechanism 2430 reaches the proximal end of the protruding track 2425 (FIG. 25), the locking mechanism 2430 will move to engage cavity 2620, thereby locking the corresponding cone assembly for drilling operations. Other or additional methods of indexing and optionally locking the cone assemblies may be used. For example, in some embodiments electromagnetic motive power may be used to index, lock, and unlock the cones without changing the fluid pressure downhole.

Arm with Index-Orienting Ring

Figure 5:
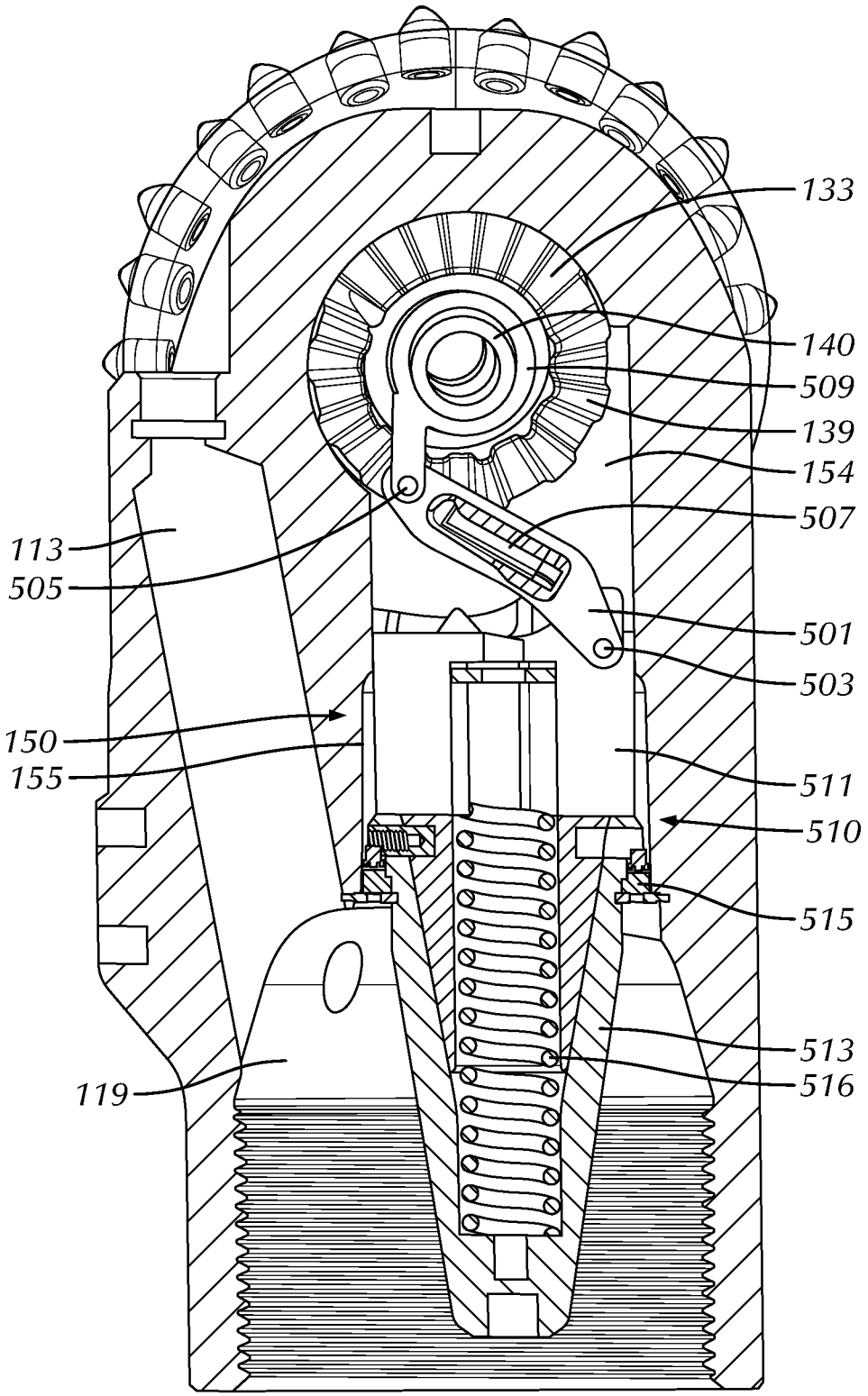
FIGS. 5 and 6 are cross-sectional views of a drill bit according to embodiments of the present disclosure.
Figure 6:
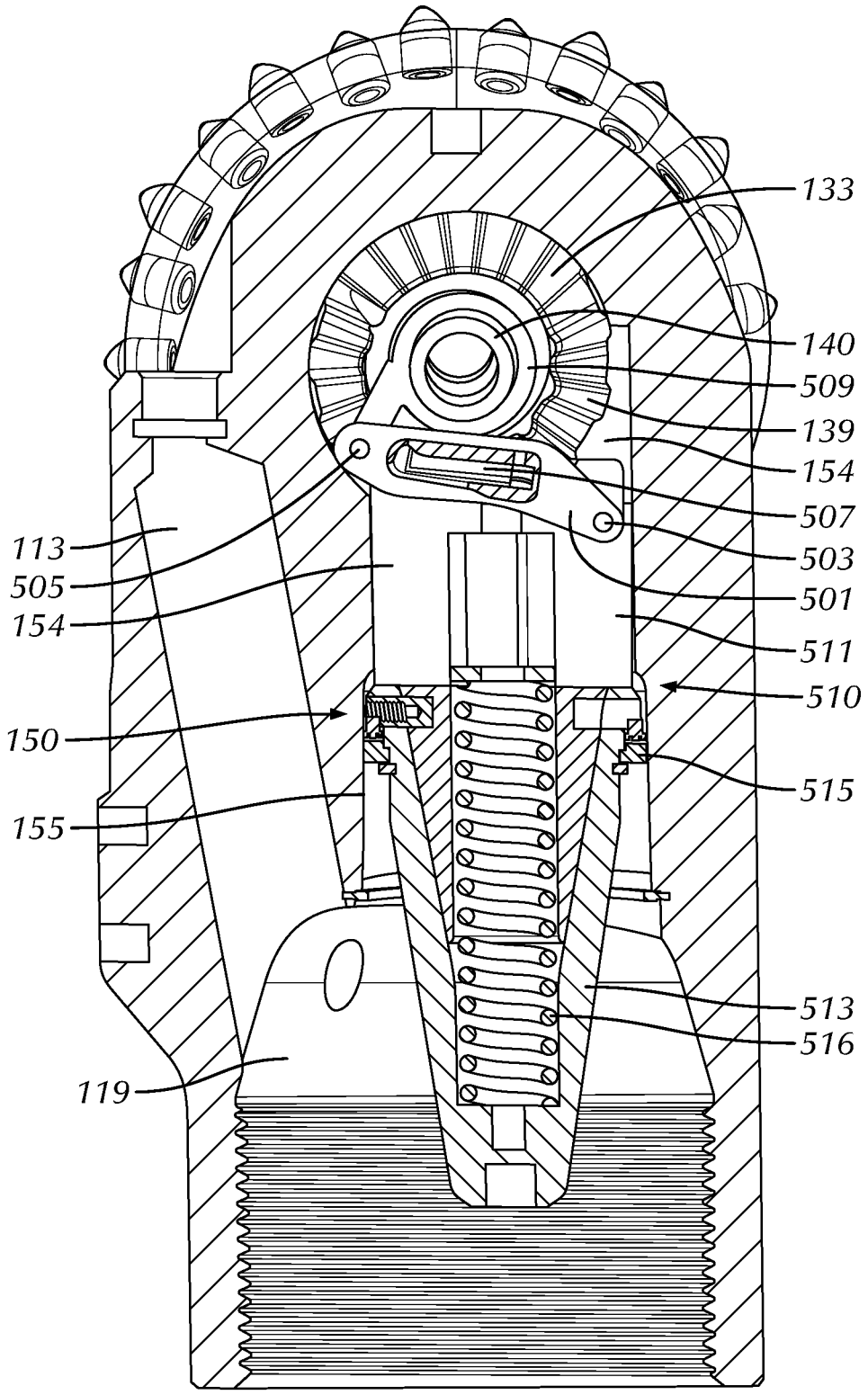
Figure 7:
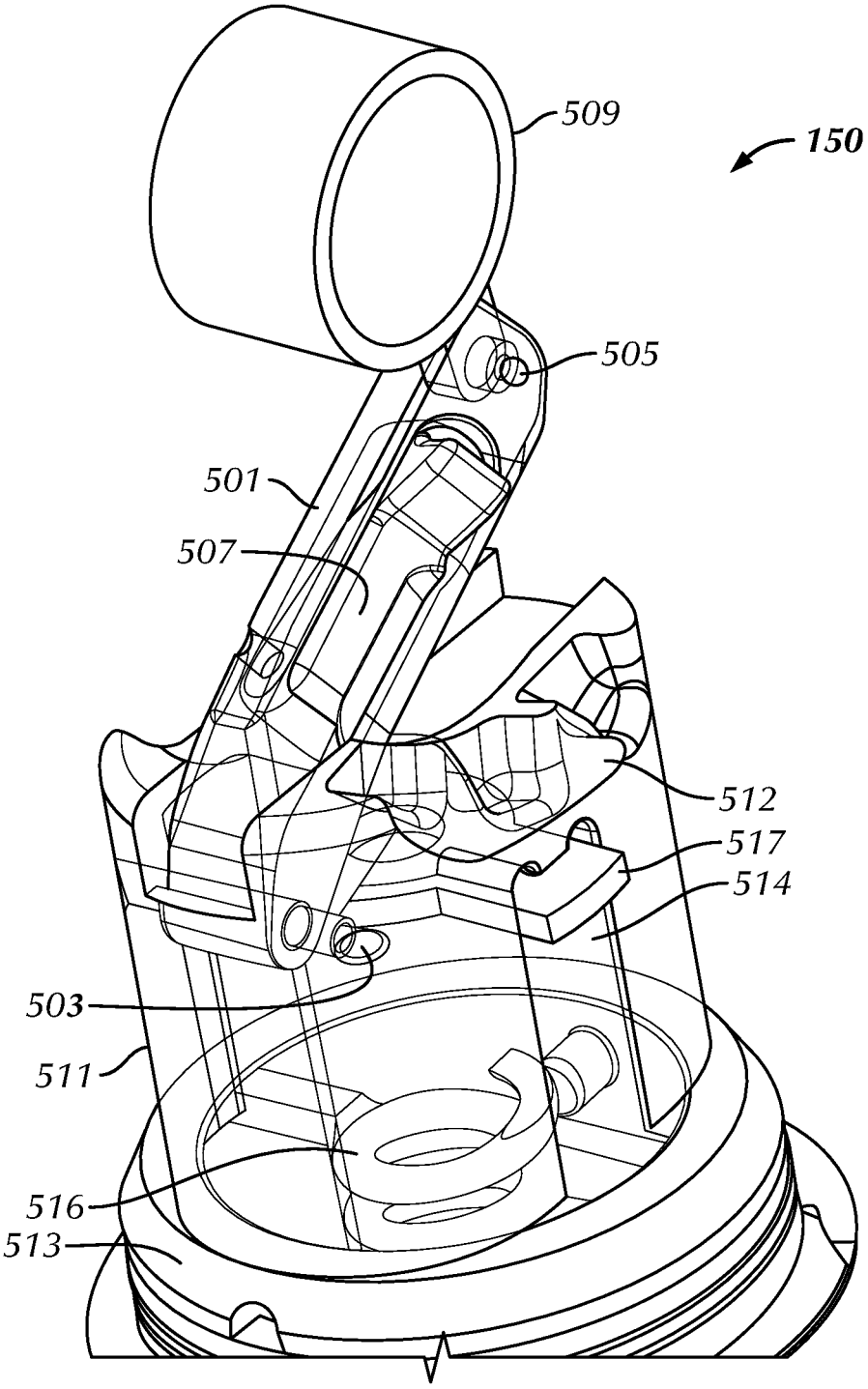
FIG. 7 shows an indexing mechanism according to embodiments of the present disclosure.

Turning to FIGS. 5-7 an indexing mechanism 150 according to embodiments of the present disclosure is shown. The indexing mechanism 150 includes an arm 501 having a first pivot 503 and a second pivot 505. The arm 501 may be positioned such that at least a portion of the arm 501 crosses a central axis 5 of the bit body 103. The first pivot 503 may be coupled to a piston 510, while the second pivot 505 may be coupled to an index-orienting ring 509. A pawl 507 is positioned in a pocket formed within the arm 501 between the first pivot 503 and the second pivot 505. The pawl 507 is biased to swing outwardly from the arm 501 and engage one or more teeth 139 of the drive cylinder 133.

The index-orienting ring 509 is positioned at a distal end of the arm 501 coupled to second pivot 505. Thus, the index-orienting ring 509 may pivot with respect to arm 501, e.g., with a range of motion of about 60°. According to other embodiments, the range of motion may be in a range of 15°-100°. The index-orienting ring 509 receives an inner lip 140 of at least two drive cylinders 133. The inner lip 140 may be located concentrically with the teeth 139. In some embodiments, the index-orienting ring 509 maintains the proper orientation of the indexing mechanism 150 with respect to the drive cylinders 133. A proximal end of the arm 501 may be coupled to a piston 510 at the first pivot 503. Arm 501 may pivot with respect to the piston 510 e.g., with a range of motion of about 60°. According to other embodiments, the range of motion may be in a range of 15°-70°.

The piston 510 includes a distal piston portion 511 having a locking surface 512 located at a distal end and a proximal piston portion 513 having a seal assembly 515 located on an outer circumference thereof. At least a part of the distal piston portion 511 may be located concentrically within the proximal piston portion 513. The distal piston portion 511 and the proximal piston portion 513 may be formed as two pieces coupled with, for example, threads, rivets, screws, or other mechanical fasteners. According to some embodiments, the piston 510 may be formed as one integral piece.

Referring briefly to FIG. 7, the distal piston portion 511 may include a slot 514. The slot 514 is located longitudinally in the surface of the distal piston portion 511. A valve plate 517 and spring 516 may be positioned within the slot 514. While the piston 510 strokes up and down, the valve plate 517 remains stationary with respect to the bit body 103. The valve plate 517 is positioned perpendicular to an axis of the slot 514, and may include two tabs that extend into the slot 514. The valve plate 517 provides a surface for the spring to act against such that the piston 510 may move up and down relative to the valve plate 517 and the bit body 103. The opening of the valve plate 517 allows the fluid located in the piston chamber 153 (e.g. air and/or oil) to move between the distal piston chamber 154 and the proximal piston chamber 155.

A spring 516 may be positioned within the piston 510. According to some embodiments, the piston may not include a spring. According to some embodiments, the spring 516 may bias the piston 510 in an up-hole position (i.e., toward the surface and in the illustrated embodiment away from the drive cylinders 133). In other words, during periods of low fluid flow or low pressure within central chamber 119, the piston 510 may be in a neutral position shown in FIG. 5, that is, arm 501 is in an extended position and the pawl 507 is engaging one or more teeth 139. The piston 510 is positioned substantially in the proximal piston chamber 155, such that seal assembly 515 is positioned at a proximal end of the proximal piston chamber 155.

The cone assembly (e.g. drive cylinder 133) may be indexed by the arm with the index-orienting ring 509 by first providing a high flow rate of fluid to the central chamber 119 of the bit body 103. The fluid may be provided, for example, through the drill string from the surface. The high fluid flow rate may increase the pressure within the central chamber 119 which applies force to the piston 510 causing the piston 510 to stroke (i.e., axially move) toward the drive cylinder 133, within the piston chamber 153. For example, the distal piston portion 511 may move into the distal piston chamber 154 and the seal assembly 515 may move toward a distal end of the proximal piston chamber 155. A rotation sensor may be positioned on the bit body 103 to monitor a radial position of the cone assembly.

During the stroke of the piston 510, the pawl 507 may be in a first position extended and engaged with at least one tooth of the drive cylinder 133. As piston 510 moves, thereby pivoting arm 501 with respect to the piston 510, the pawl 507 may rotate the drive cylinder 133 a pre-determined or set radial distance. Additionally, the index-orienting ring 509 may pivot and rotate with respect to arm 501 so that both drive cylinders 133 may be properly oriented with respect to the indexing mechanism 150. As the distal piston portion 511 moves within the distal piston chamber 154, fluid located in the piston chamber 153 may also move from the proximal piston chamber 155 to the distal piston chamber 154 through valve plate 517.

At the end of the stroke, the piston 510 may be pushed into the distal piston chamber 154 of the bit body 103. As piston 510 reaches the end of the stroke, locking surface 512 may engage and lock the drive cylinders 133 in place. Referring to FIG. 6, while in a compressed position, arm 501 may pivot with respect to piston 510 such that it is in a substantially horizontal position. The pawl 507 may be pushed into the pocket in the arm 501. The spring 516 may be in a compressed position. The distal piston portion 511 may be located substantially in the distal piston chamber 154, such that the locking surface 512 engages teeth 139 of the drive cylinders 133. According to some embodiments, the locking surface may engage teeth 139 on one of the drive cylinders 133, and in some embodiments, the seal assembly 515 may be positioned at a distal end of the proximal piston chamber 155.

When fluid pressure in the central chamber 119 is decreased, the piston 510 may move axially up-hole, disengaging locking surface 512 from drive cylinders 133 and disengaging pawl 507 from the at least one tooth 139.

Arm with Dual Engaging Key

Figure 8:
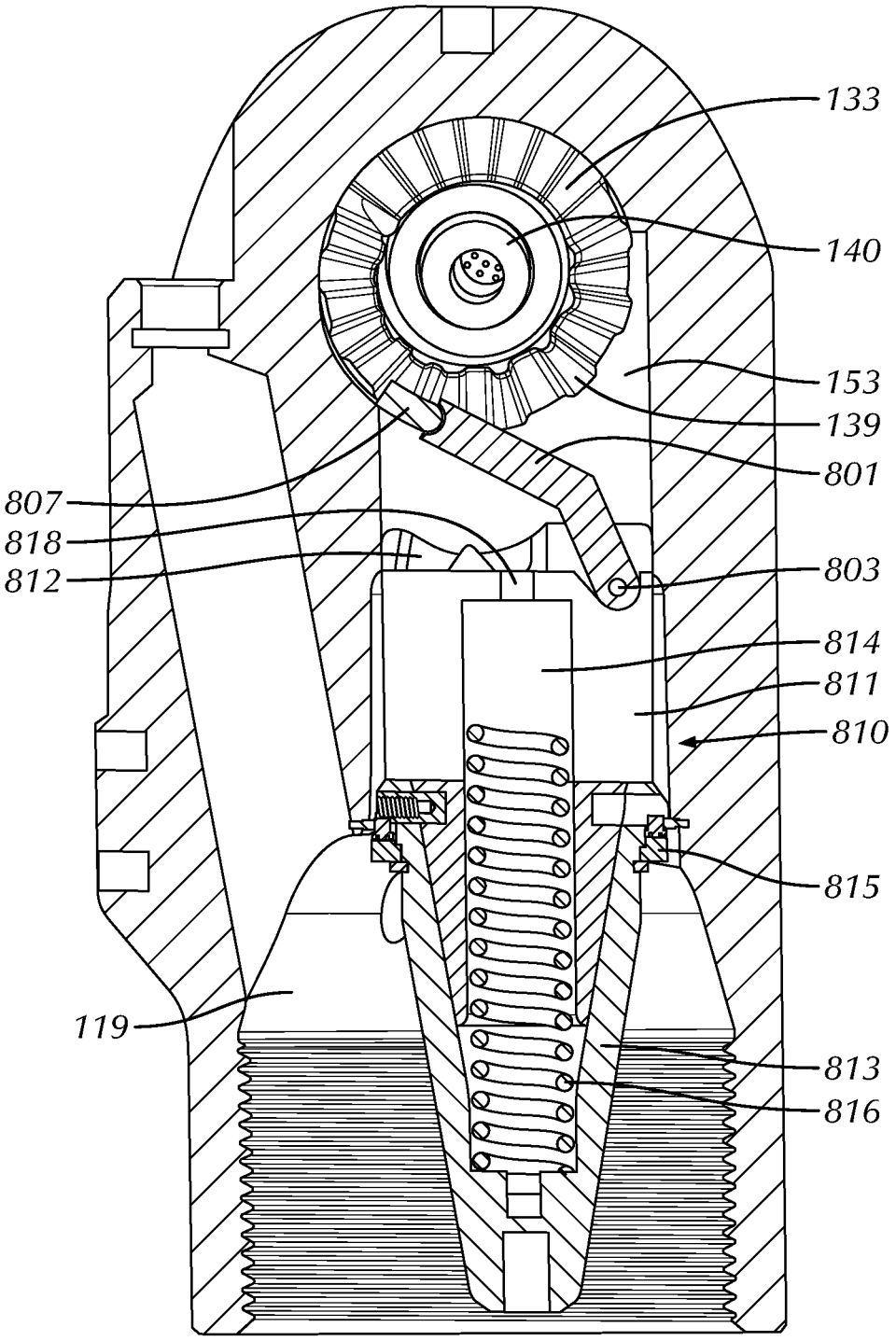
FIG. 8 is a cross-sectional view of a drill bit according to embodiments of the present disclosure.
Figure 9:
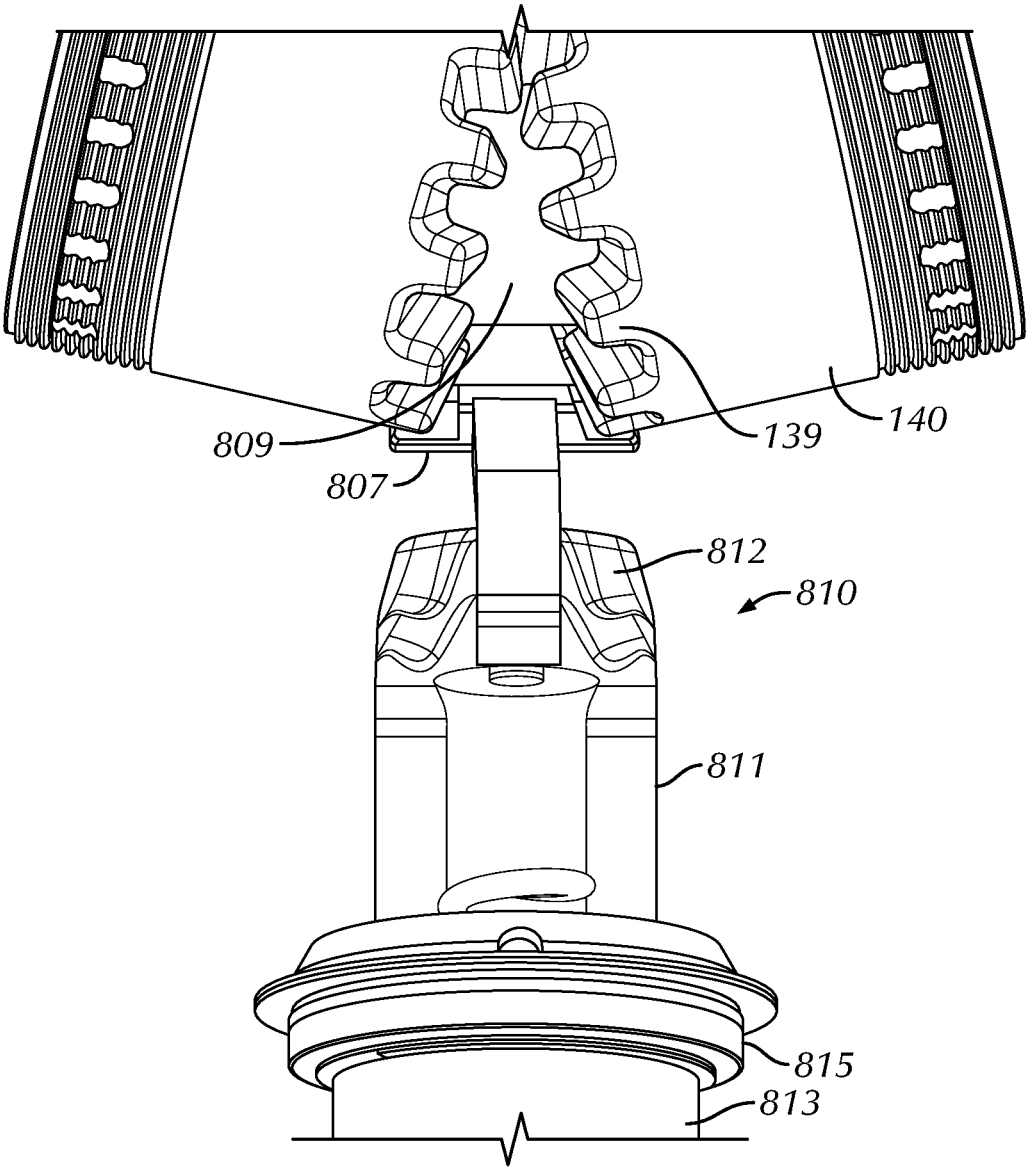
FIG. 9 shows an indexing mechanism according to embodiments of the present disclosure.

Turning to FIGS. 8 and 9, an indexing mechanism 150 according to embodiments of the present disclosure is shown. The indexing mechanism 150 includes an arm 801 having a first pivot 803. The arm 801 may be positioned such that at least a portion of the arm 801 crosses a central axis 5 of the bit body 103. The first pivot 803 may be coupled to a piston 810. A key 807 may be located at a distal end of the arm 801. The key 807 may engage one or more teeth 139 of at least two drive cylinders 133, as illustrated in FIG. 9. An orienting ring 809 is located about inner lip 140 of both drive cylinders 133. The orienting ring 809 maintains the orientation of drive cylinders 133 during indexing.

The arm 801 may be coupled to a piston 810 at the first pivot 803. Arm 801 may pivot with respect to the piston 810, e.g., with a range of motion of about 60°. According to other embodiments, the range of motion may be in a range of 15°-70°. The piston 810 is similar to piston 510 described with respect to the arm with index-orienting ring embodiment Like numbers indicate like parts. For instance, 810 and 510 refer to the piston; however, there may be differences between piston 810 and piston 510 (e.g., the piston 810 may not include a valve plate positioned in slot 814, as illustrated in FIG. 8). The distal piston portion 811 may, however, include an opening 818 to allow fluid communication between the distal piston chamber 154 and proximal piston chamber 155. Embodiments disclosed herein may be practiced with or without the valve plate 514 without departing from the scope of the present disclosure.

Cone assemblies may be indexed by first providing a high flow rate of fluid to the central chamber 119 of the bit body 103. The high fluid flow rate may increase the pressure within the central chamber 119 which applies force to the piston 810, causing the piston 810 to stroke (i.e., axially move) toward the drive cylinder 133, within the piston chamber 153. For example, the distal piston portion 811 may move into the distal piston chamber 154 and the seal assembly 815 may move toward a distal end of the proximal piston chamber 155.

Initially arm 801 may be in an extended position and the key 807 may engage with at least one tooth 139 of at least two drive cylinders 133. As arm 801 moves with piston 810 and pivots, the key 807 also moves, thereby rotating the at least two drive cylinders 133 a pre-determined or set radial distance. Once the piston 810 reaches the end of the stroke, locking surface 812 will engage the drive cylinders 133.

Pawl Driven Cone drive

Figure 10:
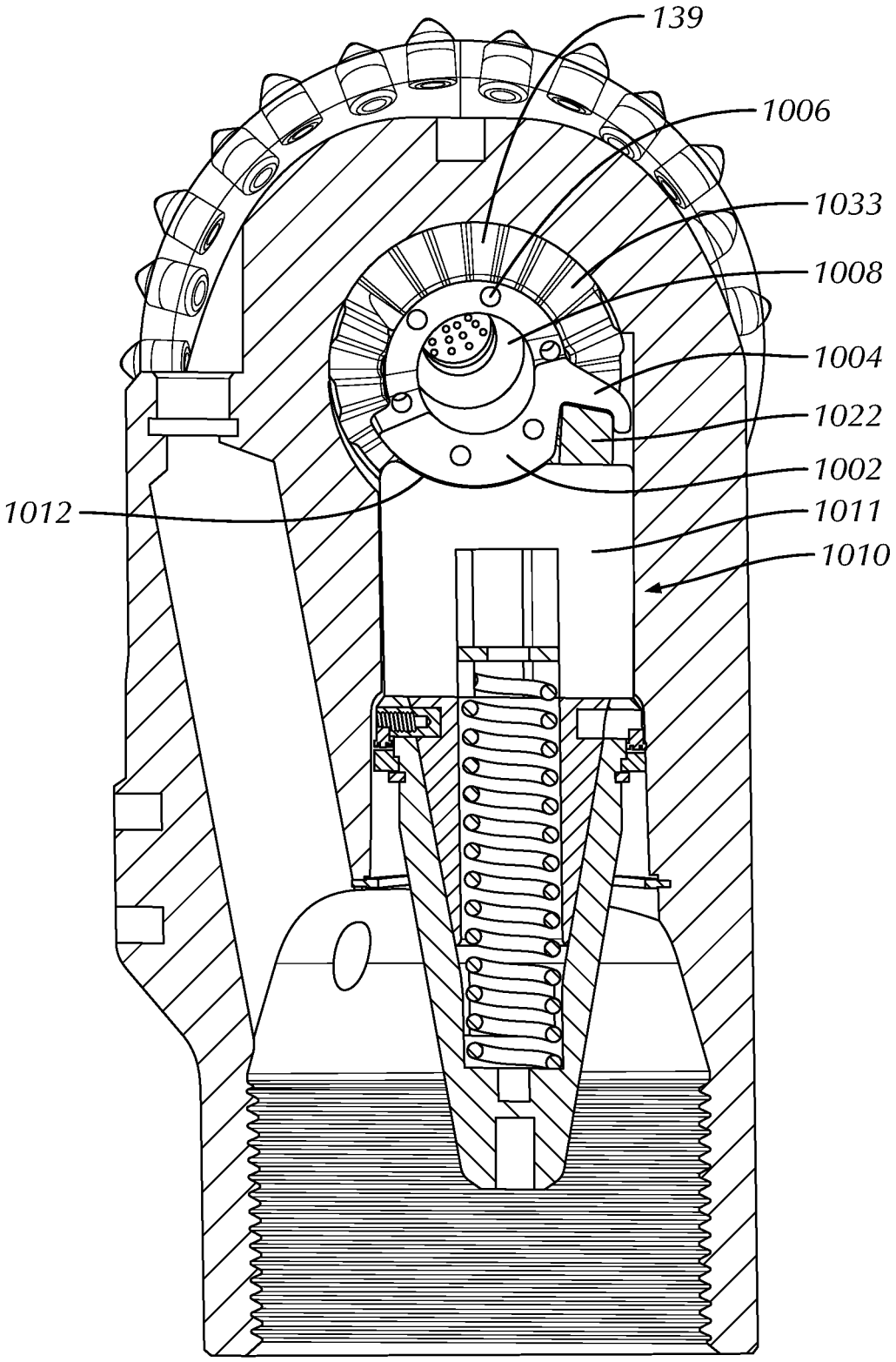
FIGS. 10 and 11 are cross-sectional views of a drill bit according to embodiments of the present disclosure.
Figure 11:
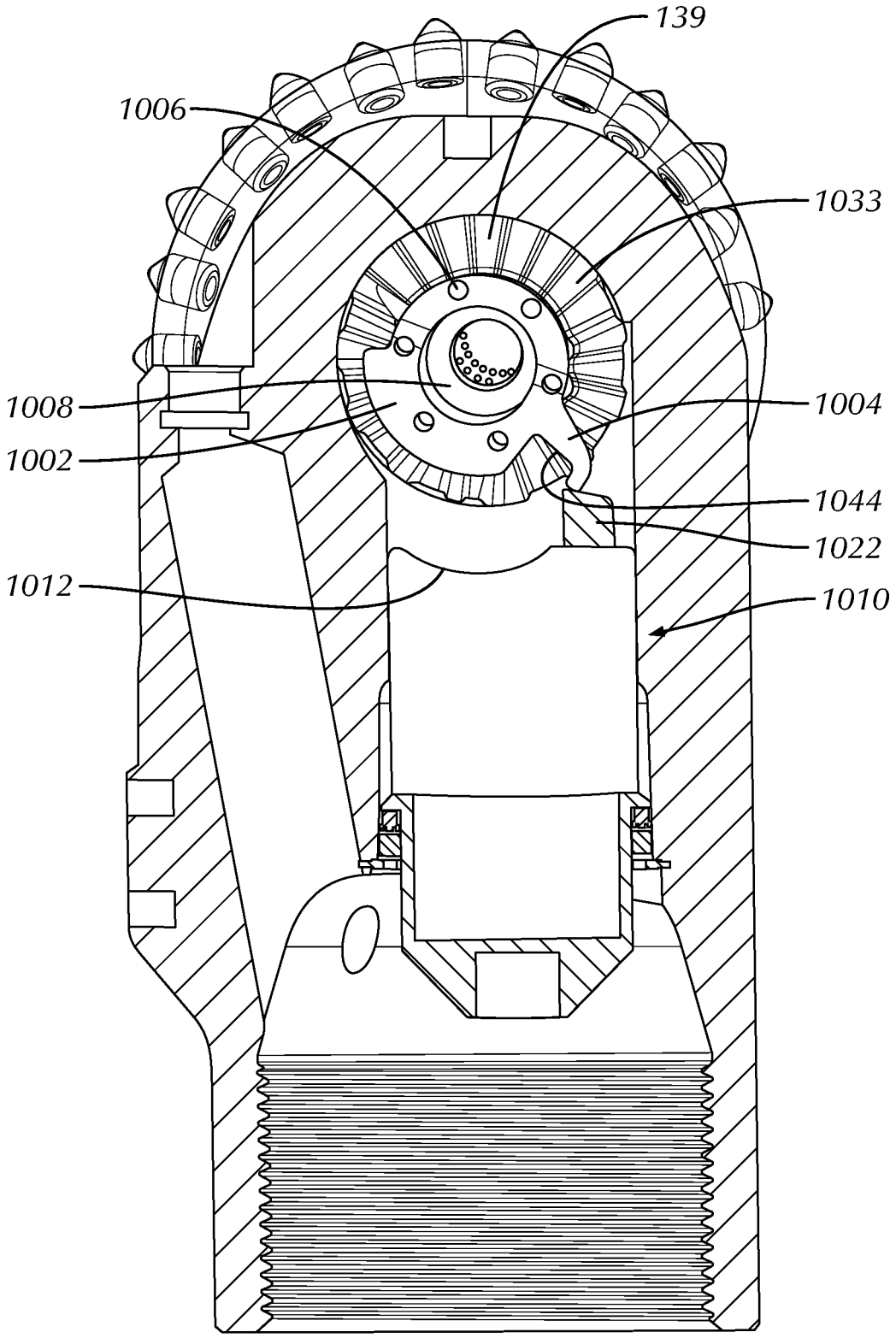
Figure 12:
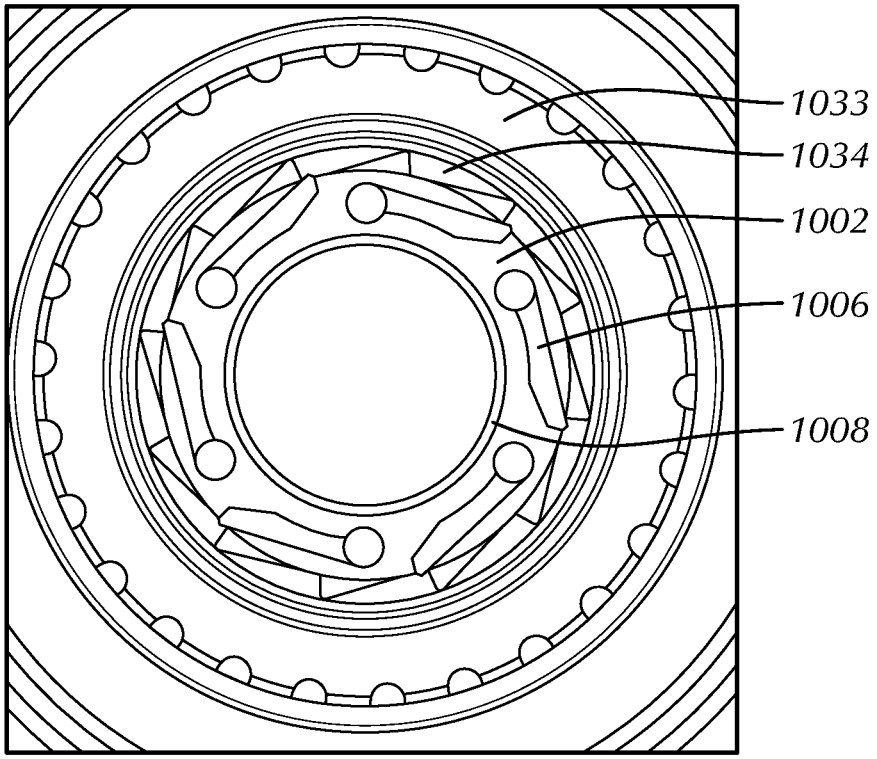
FIGS. 12 and 13 show an indexing mechanism according to embodiments of the present disclosure.

Turning to FIGS. 10-13, an indexing mechanism 150 according to embodiments of the present disclosure is shown. The indexing mechanism 150 includes cone driver 1002 having a drive cylinder ring 1008, a hook 1004 and a plurality of pawls 1006 positioned around the circumference of the drive cylinder ring 1008, as shown in FIG. 12. The plurality of pawls 1006 may be biased in a radially outward direction.

Figure 13:
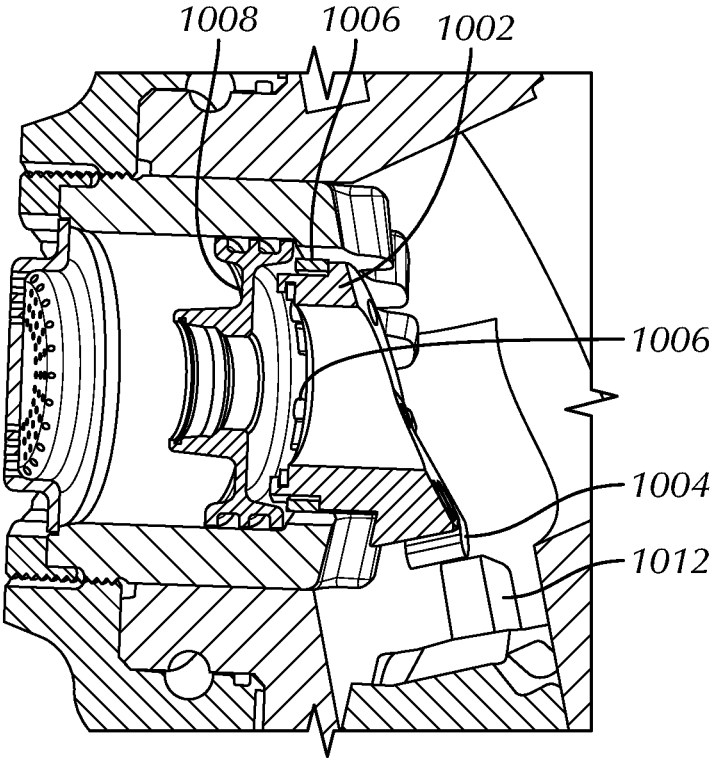

The cone driver 1002 may be coupled to the drive cylinder ring 1008, for example, the cone driver 1002 may be a single piece such that the hook 1004 is positioned proximate a lower lip of the drive cylinder ring 1008 as illustrated in FIG. 13. According to some embodiments, the cone driver 1002 and the drive cylinder ring 1008 are separate components that may be coupled by, for example, a press fit, threads, and/or mechanical fasteners. The drive cylinder ring 1008 may be located and/or coupled to an inside diameter of at least one drive cylinder 1033. Drive cylinder 1033 may have at least a portion of an inner diameter with a saw-tooth profile 1034 to engage the pawls 1006. When the pawls 1006 are engaged with the saw-tooth profile 1034, the drive cylinder 1033 will rotate with the cone driver 1002.

The piston 1010 is substantially similar to piston 510 described with respect to the arm with index-orienting ring embodiment described above, however, there are some differences identified below. Like numbers indicate like parts, for example, 1010 and 510 refer to the piston. Piston 1010, specifically the distal piston portion 1111, includes a finger 1022 to engage hook 1004. As shown in FIG. 10, when the piston 1010 is in the compressed position, the finger 1022 will engage the hook 1004, causing rotation of the cone driver 1002. Rotation of the cone driver will rotate the pawls 1006 into engagement with the saw-tooth profile 1034 of the drive cylinder 1033. Locking surface 1012 is provided to lock the drive cylinders 1033 in place at the top of the stroke. The locking surface 1012 may lock the drive cylinders 1033 when the drive cylinders 1033 are no longer being rotated by the pawls 1006. For example, once the finger 1022 is engaged in the slot 1044 of arm 1004, rotation of the cone driver 1002 and drive cylinder 1033 is temporarily halted so that the drive cylinders 1033 may be locked in place.

In the decompressed position, shown in FIG. 11, the piston 1010 may be positioned at a proximal end of the proximal piston chamber 155. The hook 1004 is biased toward a proximal end of the drill bit 101 and the pawls 1006 are disengaged from the saw-tooth profile 1034.

The cone assemblies may be indexed by providing a high flow rate of fluid to the central chamber 119 of the bit body 103. The increased pressure in the central chamber 119 may cause the piston 1010 to stroke toward the drive cylinders 1033. As the piston 1010 moves axially, the finger 1022 may engage the hook 1004 of the cone driver 1002. Once engaged, the finger 1022 may cause the cone driver 1002 to rotate as the piston 1010 continues stroking toward the drive cylinders 1033.

As the cone driver 1002 rotates, pawls 1006 rotate and engage the saw-tooth profile 1034 located on the inner diameter of the drive cylinders 1033. As the pawls 1006 rotate with the cone driver 1002, the drive cylinder 1033 will also rotate. Thus, the rotation of the cone driver 1002 directly drives the rotation of at least one of drive cylinders. Once piston 1010 reaches the end of the stroke, the locking surface 1012 will engage and lock at least one of the drive cylinders 1033.

Finger Drive

Figure 14:
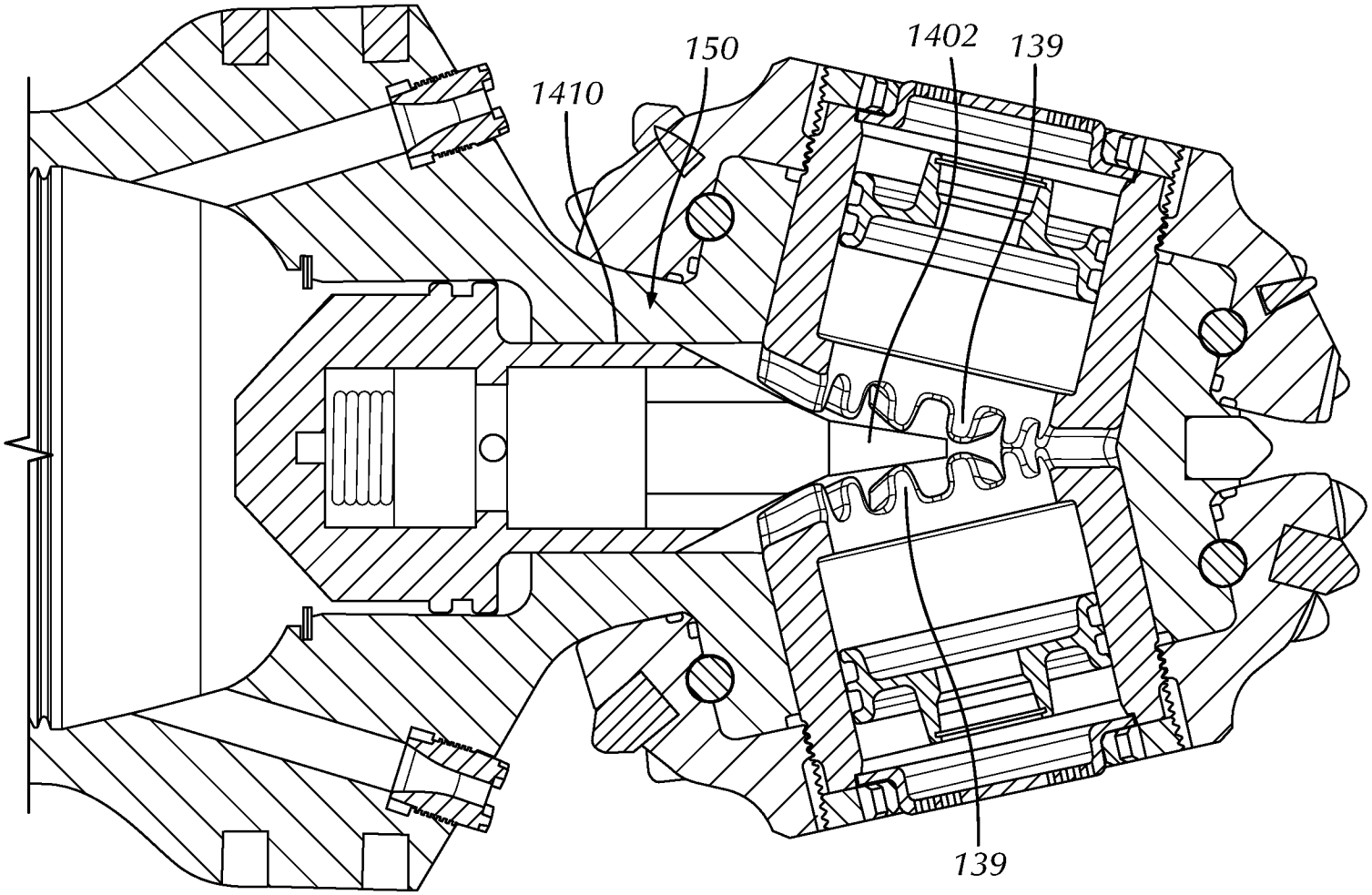
FIGS. 14-16 are cross-sectional views of a drill bit according to embodiments of the present disclosure.
Figure 15:
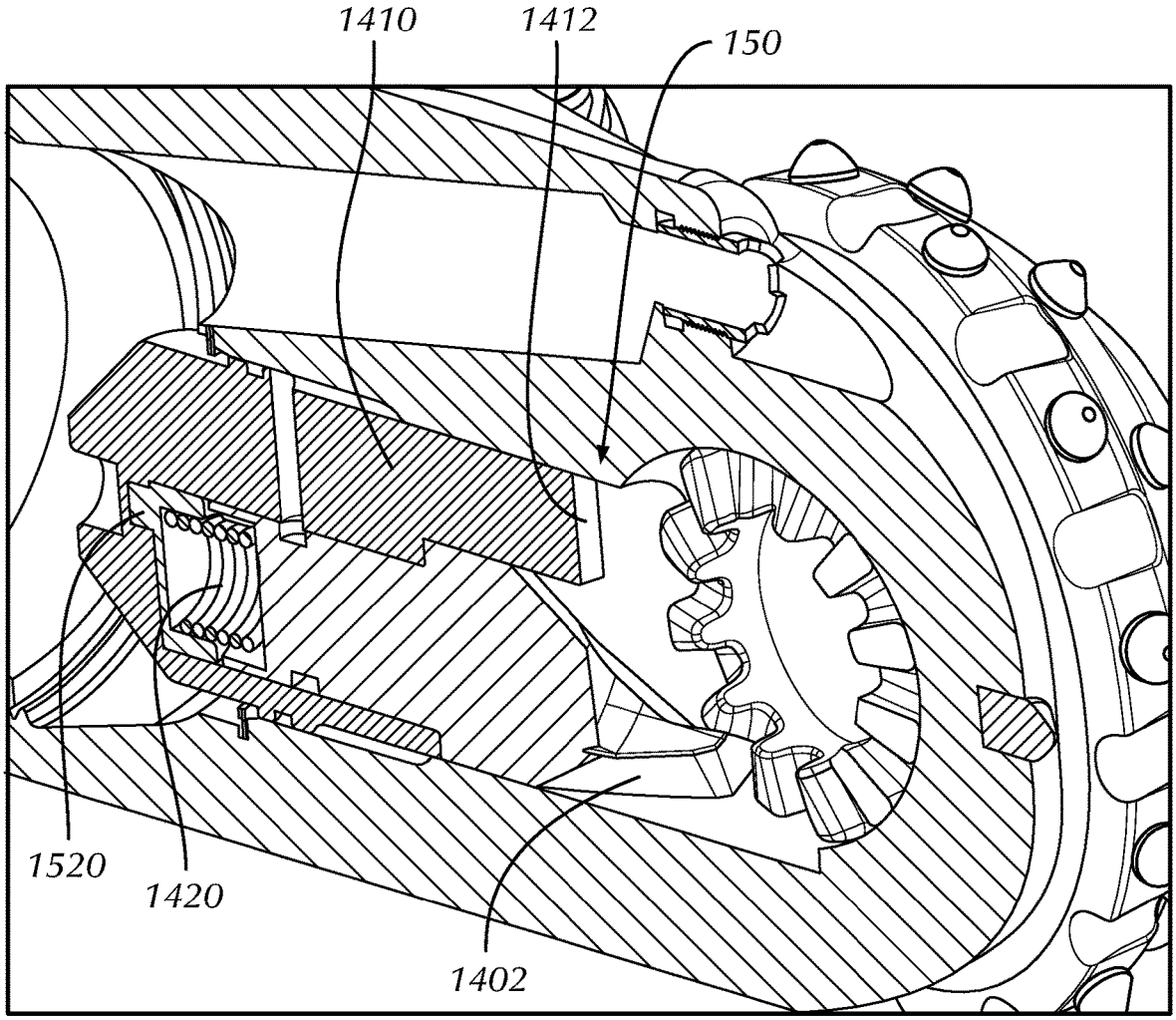
Figure 16:
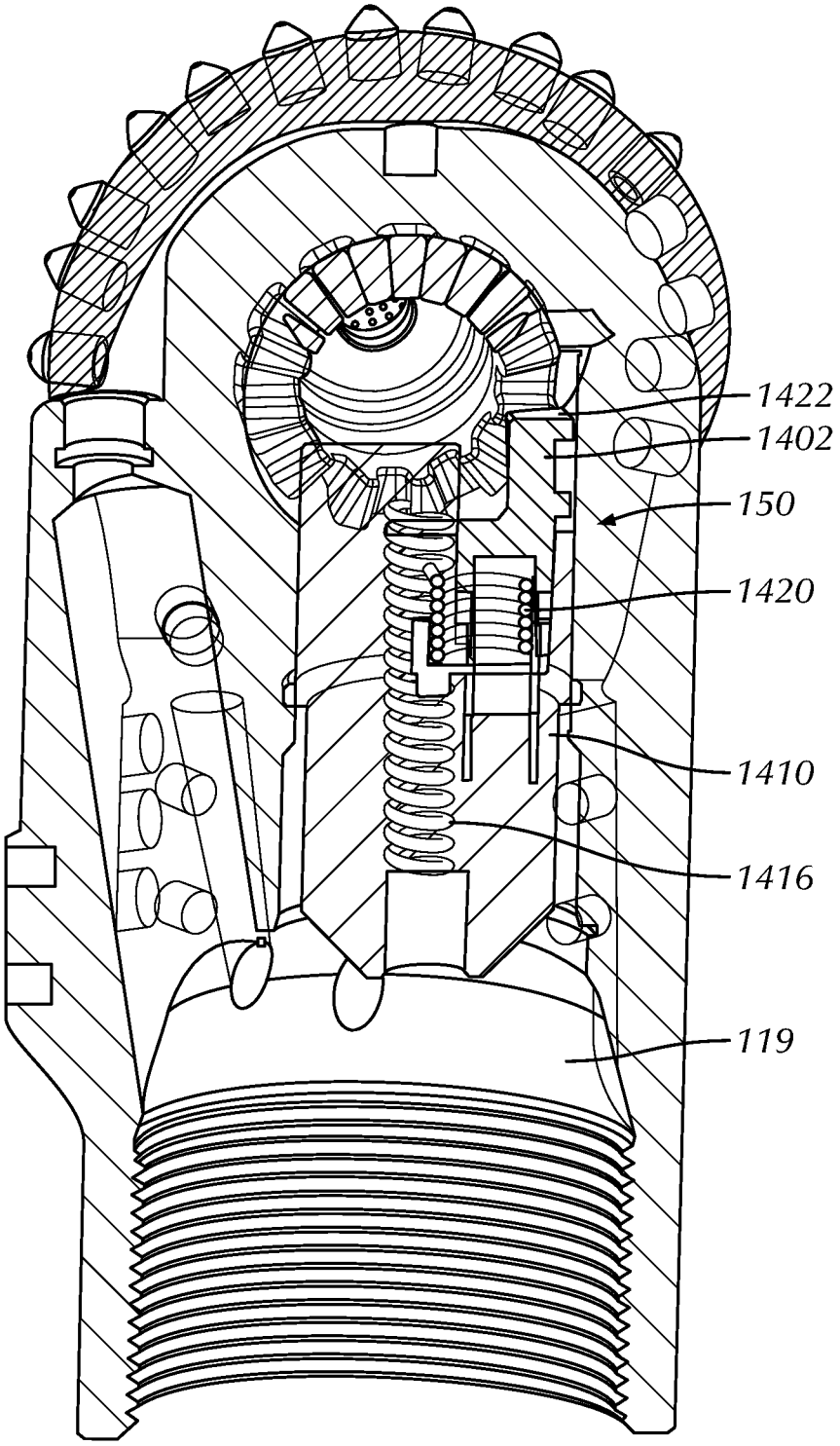

FIGS. 14-16 show an indexing mechanism 150 according to embodiments of the present disclosure. The indexing mechanism 150 includes a drive finger 1402 located within a piston 1410. A spring 1420 may be positioned at a proximal end of the drive finger 1402 within a chamber 1415 of piston 1410. In some embodiments, the spring may be a torsion spring 1420 and a torsion member 1520 may be provided to the chamber 1415 to orient the turning motion of the drive finger caused by the torsion spring 1420. As illustrated in FIG. 16, according to some embodiments, a spring 1616 may be positioned in the piston 1410 to bias the piston 1410 in an up-hole direction toward a proximal end of the bit body 103.

The finger drive may be used to index the cones by providing a high flow rate of fluid to the central chamber 119 of the bit body 103. The high pressure caused by the fluid may push the piston 1410 toward a distal end of the piston chamber 153. Axial movement of the piston 1410 toward the distal end of the piston chamber 153 will likewise cause movement of the drive finger 1402 toward the drive cylinders 1033 located proximate a distal end of the piston chamber 153. During the axial movement, the drive finger 1402 may engage at least one tooth 139 of at least one of the drive cylinders 1033. In embodiments where spring 1420 is a torsion spring, rotation of the drive finger 1402 may allow the drive finger 1402 to engage at least one tooth 139 for indexing. Thus, as the piston 1410 continues to stroke toward a distal end of the piston chamber 153, the drive finger 1402 may rotate at least one of the drive cylinders 1033. As the drive cylinders 1033 have interlocking teeth 139 at a distal end, both drive cylinders will rotate. Once the piston 1410 reaches the distal end of the stroke, a tooth located on a locking surface 1412 of the piston 1410 may engage at least one of the drive cylinders 1033 and lock the drive cylinders 1033 in place. When pressure in the central chamber 119 is released (e.g., due to a reduction in drilling fluid pressure), piston 1410, including drive finger 1402, retract toward a proximal end of the central chamber 119. This allows the indexing mechanism 150 to reset for the next index. Drive finger 1402 can rotate within 1410 allowing the pawl tip of drive finger 1402 to swing away and reposition itself under the tooth. The torsion spring 1420 drives this motion.

Drop variation of Finger drive

Figure 17:
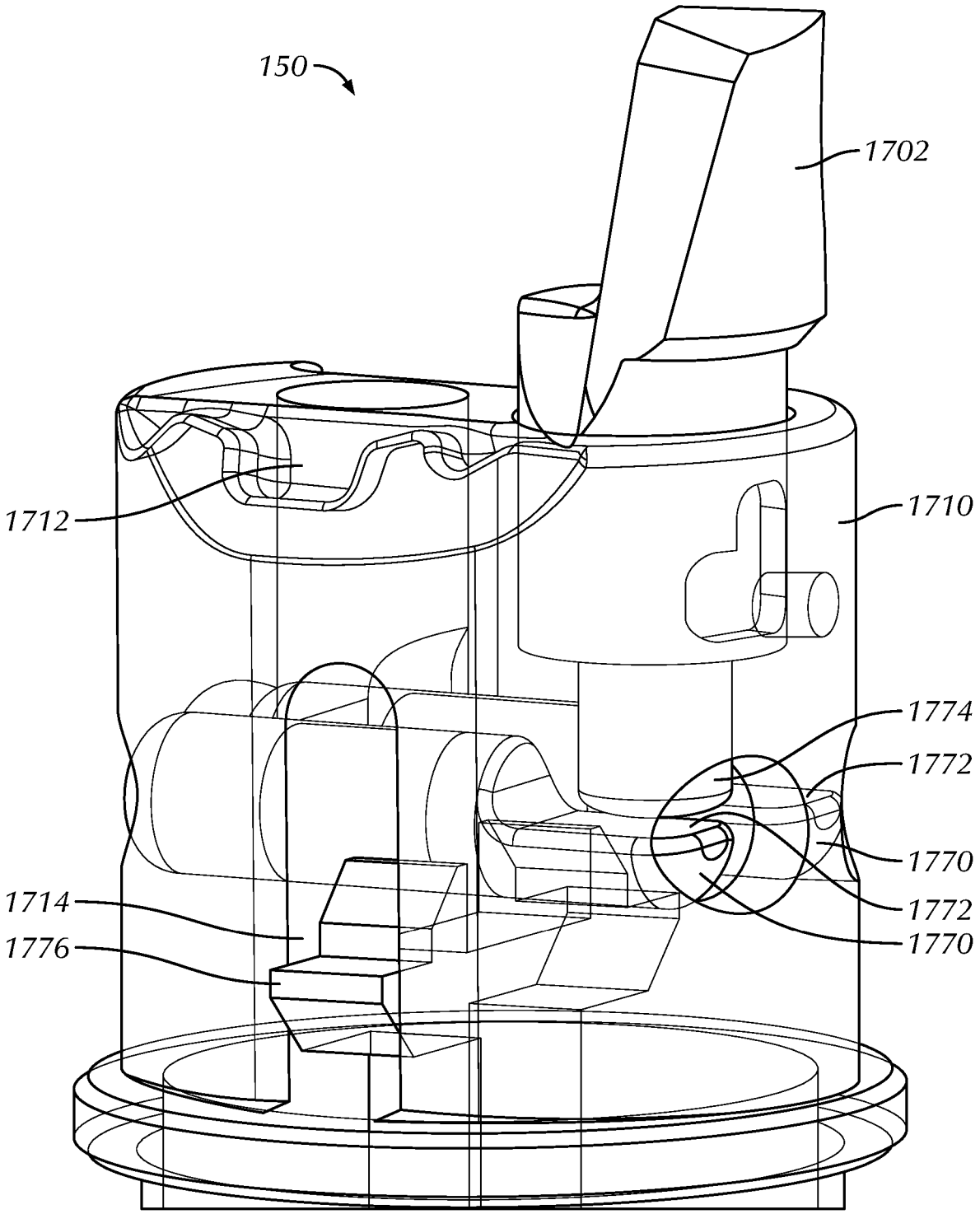
FIG. 17 shows an indexing mechanism according to embodiments of the present disclosure.

FIG. 17 shows another embodiment of an indexing mechanism 150. The indexing mechanism includes a drive finger 1702 located within a piston 1710. A pair of rotatable slats 1770 are located proximate a proximal end of the drive finger 1702. Any suitable number of slats may be used. The slats 1770 may include a portion having a substantially planar face 1772. As shown in FIG. 17, the substantially planar face 1772 may engage the proximal end 1774 of the drive finger 1702, thereby holding drive finger 1770 in place relative to the piston 1710.

A catch 1776 may be provided for positioning the substantially planar face 1772 of the slats 1770 toward the proximal end 1774 of the drive finger 1702. The catch 1776 may move axially with respect to the piston 1710. For example, a pair of slots 1714 may be located in the piston 1710 to allow axial movement of the catch 1776. As shown in FIG. 17, the catch 1776 engages the slats 1770, which in turn engage a proximal end 1774 of the drive finger. When the catch 1776 is not engaged with the slats 1770, the substantially planar faces 1772 of the slats 1770 may rotate inward toward each other such that the drive finger 1702 moves axially toward a proximal end of the piston 1710.

The drop finger drive may be used index the cone assemblies by providing a high flow rate of fluid to the central chamber 119 of the bit body 103. The high pressure caused by the fluid may push the piston 1710 toward a distal end of the piston chamber 153. Axial movement of the piston 1710 toward the distal end of the piston chamber 153 will likewise cause movement of the drive finger 1702 toward the drive cylinders 1033 positioned proximate a distal end of the piston chamber 153.

During the axial movement, the drive finger 1702 may engage at least one tooth 139 of at least one of the drive cylinders 1033. Thus, as the piston 1710 continues to stroke toward a distal end of the piston chamber 153, the drive finger 1702 may rotate at least one of the drive cylinders 1033. As the piston 1710 strokes toward the drive cylinders 1033, the catch 1776 may engage a protrusion located on an inner diameter of the piston chamber 153. The piston 1710 will continue to stroke toward a distal end of the drill bit 101 once the catch 1776 engages the protrusion, causing relative axial movement between the piston 1710 and the catch 1776. This relative axial movement results in the catch 1776 disengaging from the slats 1770.

With the catch 1776 no longer supporting the slats 1770, the engagement force between the drive finger 1702 and the drive cylinders 1033, causes the drive finger 1702 to move up-hole, and axially toward the slats 1770. This axial movement of the drive finger 1702 rotates the slats 1770 inwardly such that the substantially planar faces 1772 are substantially parallel. Thus, the drive finger 1702 may be disengaged from the drive cylinders 1033. Meanwhile, the piston 1710 may continue moving axially until the piston 1710 reaches the distal end of the stroke. At the end of the stroke, the locking surface 1712 may engage the teeth 139 to lock the drive cylinders 1033 in place.

Helical Drive

Figure 18:
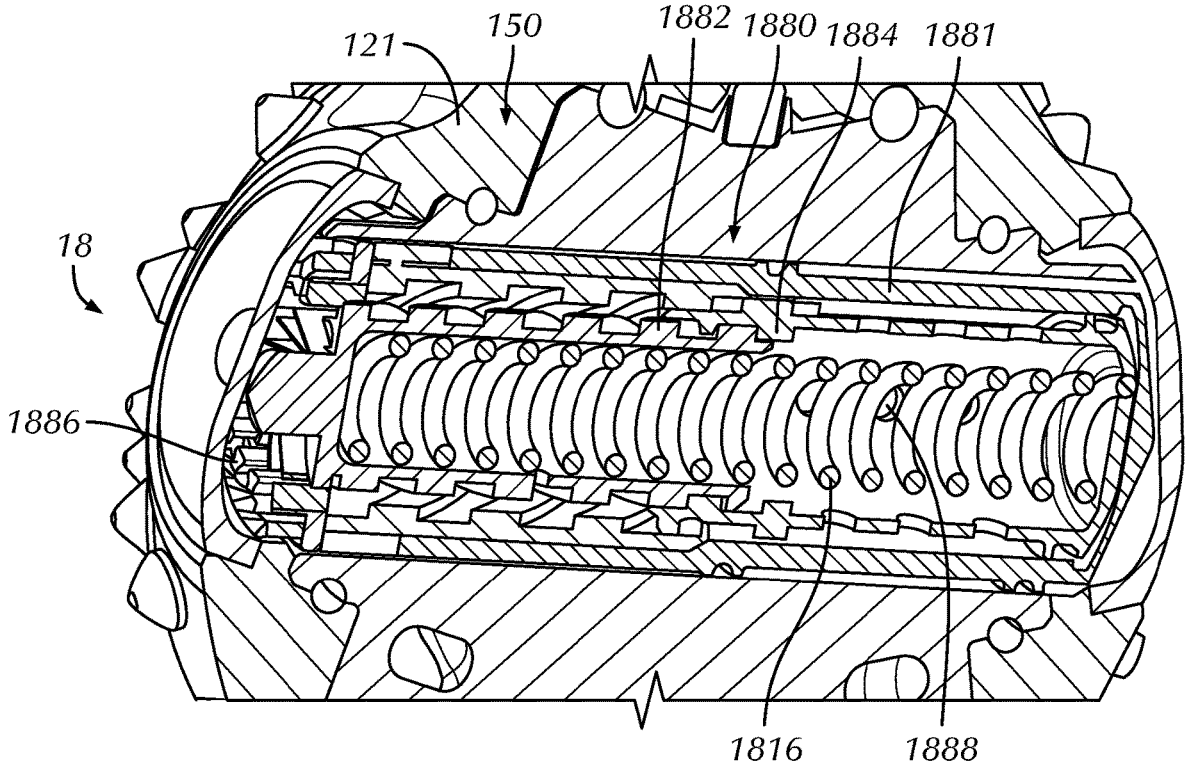
FIG. 18 is a cross-sectional view of a drill bit according to embodiments of the present disclosure.

FIG. 18 shows another embodiment of an indexing mechanism 150. The indexing mechanism 150 includes at least two concentrically positioned helix members 1882, 1884 forming a helix drive 1880 located in a drive sleeve 1881. The concentrically positioned helix members may rotate and slide relative to each other. The indexing mechanism 150 may also include a spring 1816 located along a central axis 18 of the helix members 1882, 1884. At least one pawl, 1886 may be located at a distal end of the helix drive 1880 for providing a ratcheting motion to the cones 121. At least one port 1888 may be located in a wall of at least one of the helix members, for example, helix member 1884. The port may be in fluid communication with at least one locking mechanism. For example, a hydraulic locking mechanism may be actuated once the helix members 1882 and 1884 are aligned to allow fluid to enter port 1888.

The cones 121 may be indexed with the helical drive by providing a flow of fluid to the helical drive. For example two pistons, each a different size, may act as a pressure magnifier in a proximal end of the drill bit. Drilling fluid provided to the drill bit may enter the helix members 1882 and 1884 of the indexing mechanism 150 through a valve, which redirects magnified pressurized hydraulic fluid first to rotate the helix members 1882 and 1884. Once the cones 121 have been indexed to a desired position, the ports 1888 may align with corresponding ports located on the drive sleeve 1881 to activate a locking mechanism to lock the cones 121 in place.

Motor Drive

Figure 19:
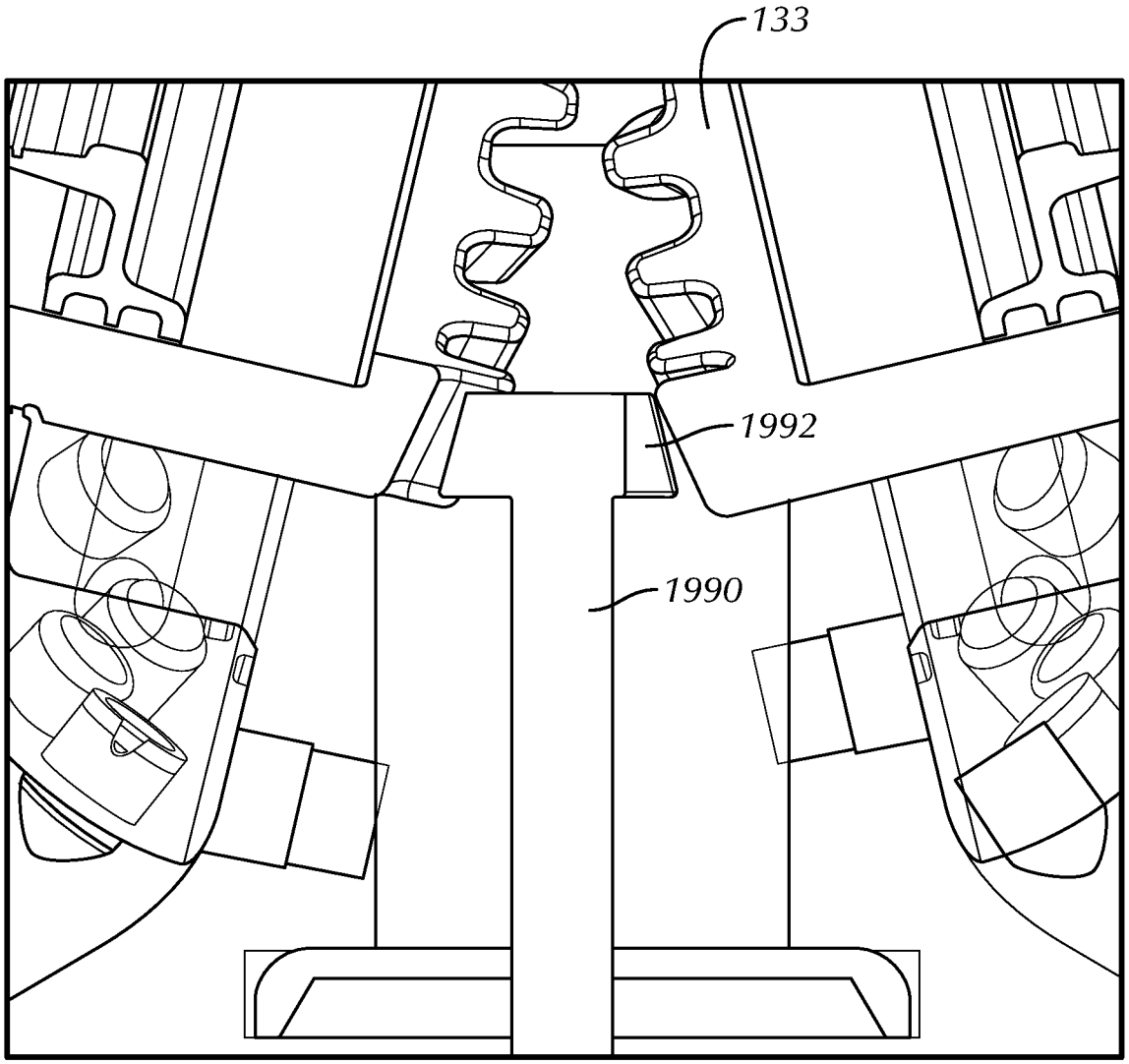
FIG. 19 shows an indexing mechanism according to embodiments of the present disclosure.

FIG. 19 shows another embodiment of an indexing mechanism 150. The indexing mechanism 150 includes a shaft 1990 having a gear 1992 located at a distal end thereof. The gear 1992 may engage at least one drive cylinder 133. A proximal end of the shaft 1990 may be coupled to a motor, for example, a turbine, a mud motor, or a positive displacement motor. A rotation sensor or feedback mechanism may be located on the motor to monitor the rotation of the motor and the cone assembly or a rotation sensor or feedback mechanism may be located on the bit, as discussed above. According to some embodiments, the shaft 1990 may be located in a piston. The piston may be similar to for example, piston 510, having a locking surface 512. The shaft 1990 may move axially with respect to the piston.

The drive cylinder 133 may be indexed with the motor by rotating the shaft 1990 and the gear 1992 with the motor. Once the cone 121 has been indexed to a desired position, the motor may be stopped. This may act as a locking mechanism. In another embodiment, a flow of fluid may be provided to a central chamber causing the piston to move axially toward the drive cylinders 133 and engage the locking surface with the drive cylinders 133.

Referring now to FIG. 21, the indexing mechanism 250 may be a motor 2150, for example, a turbine, a mud motor, a positive displacement motor, or any other suitable rotating mechanism, coupled to wheel 221 to rotate and index the wheel 221. The motor 2150 may be arranged such that a rotor is fixed to the bit body and a stator is located on the wheel 221, to drive rotation of the bit. The motor 2150 may be hydraulically or pneumatically actuated. That is, hydraulic or pneumatic flow 2101 of fluid may be used to drive the motor 2150 to rotate the wheel 221. The motor 2150 or wheel 221 may include a rotation sensor or feedback mechanism to monitor the rotation of the motor 2150. In some embodiments, the motor may be electronically actuated.

To index a wheel 221, the drillstring may be raised slightly so that the wheels 221 are not applying pressure to a bottom of the wellbore. For example, the string may be raised to make a connection. The motor 2150 may be actuated, for example, hydraulically, thereby rotating the wheel indexing the wheel 221 to expose unused or lightly used cutting elements 223 (e.g., to rotate the wheel to expose a different portion of the wheel). A rotation sensor may indicate when the wheel 221 has been indexed to a desired location, at which point a locking mechanism may be used to lock the wheel in place and/or pressure reapplied to the drillstring to lock the wheel 223 in place. In other embodiments, the wheel 221 may be rotated to a random location (i.e., without monitoring the rotation with sensors) and the drill string may be lowered to contact a bottom of the wellbore. The weight on the bit 201 may be sufficient to lock the wheels in place before drilling is resumed.

Jet Drive

Figure 22:
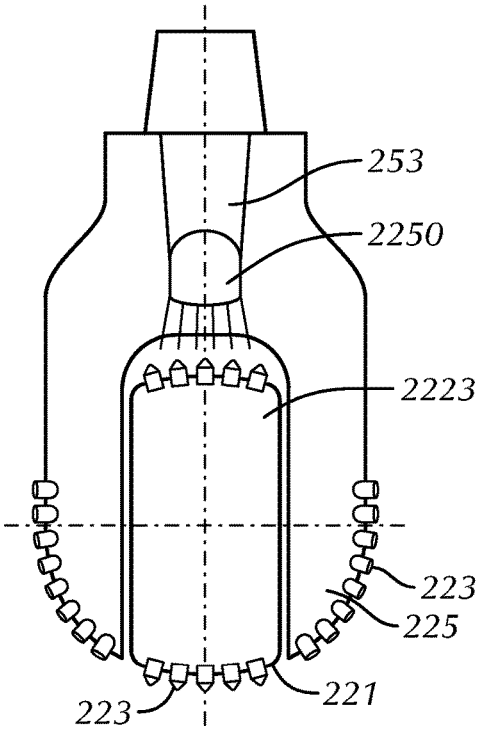

FIG. 22 shows another embodiment of an indexing mechanism 250. The indexing mechanism may be a jet nozzle 2250 located in central chamber 253. The jet nozzle 2250 may be located proximate a proximal end 2223 of the wheel 221. The jet nozzle 2250 may provide a stream of fluid to rotate the wheel 221. For example, to index wheel 221, the drillstring may be raised so that the wheel 221 is not applying pressure to a bottom of the wellbore. Fluid may be provided to the jet nozzle 2250 that directs a jet of fluid to the wheel 221, thereby indexing the wheel. In some embodiments, the wheel may be indexed to a random location. In other embodiments, the wheel may be indexed to a desired position, for example, by jetting fluid for predetermined amount of time or a signal from a rotation sensor may indicate to stop the jet of fluid and pressure reapplied to the drillstring to lock the wheel 221 in place.

Spring Biased Indexable Member

Figure 23:
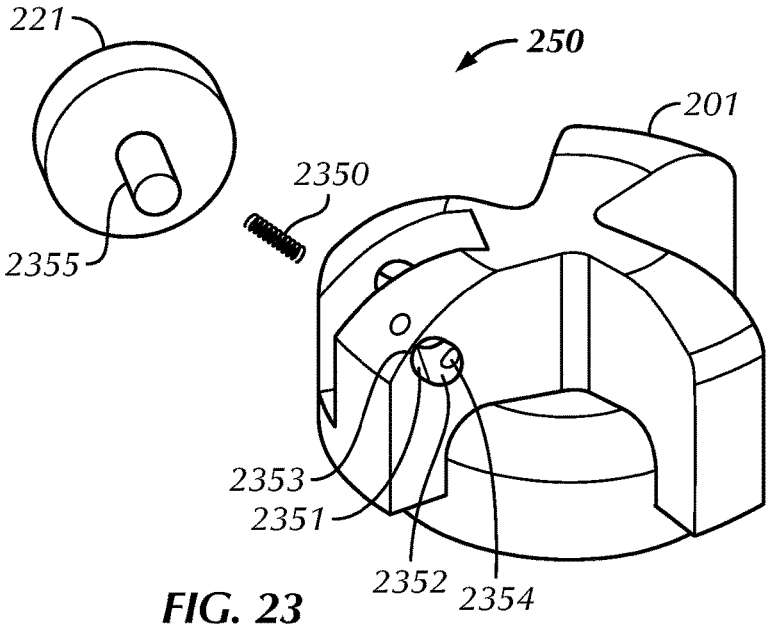
FIG. 23 is an exploded view of an indexing mechanism according to embodiments of the present disclosure.

FIG. 23 shows another embodiment of an indexing mechanism 250. The indexing mechanism 250 may include a spring 2350 in recess 2354 having one end coupled to a bit body 201 and another end coupled to a protrusion 2355 of the wheel 221. The bit body 201 may include a slot 2351 that receives the protrusion 2355 of the wheel 221. When pressure is applied to the drillstring and the wheel 221 contacts a bottom of the borehole, the protrusion 2355 is located against a proximal end 2352 of slot 2351, thereby contacting spring 2350, as shown in FIG. 23. When it is desired to index the wheels, the drillstring may be raised from the bottom of the borehole. As the contact force of the drillstring against the bottom hole no longer acts on the spring 2350, the spring may extend and push the wheel along the slot 2351, thereby moving the protrusion 2355 toward the distal end 2353 of the slot 2351. To index the wheel 221, the bit may be moved upward and downward in the borehole to rotate the wheel 221. The contact force of the wheel against the walls of the borehole may generate a drag force to rotate the wheel. To drill again, the drillstring and bit body 201 may be lowered against the bottom of the borehole to lock the wheel in place. In some embodiments, sensors, including but not limited to, rotation sensors, and sensors to monitor the cutting elements may be located on the bit body, to aid in indexing the wheel.

Command System

Drill bits in according to embodiments disclosed herein may include a command system. The command system may be an electronic control module located in the drillstring, for example in the drill bit 101, adjacent to the drill bit, or in a sub uphole of the drill bit, in communication with equipment located at the surface. The command system may communicate with the surface via telemetry, wireline, mud pulse, or any suitable communication. The command system may also be an electronic control module located at the surface in communication with various sensors and monitoring tools located in the drillstring and the drill bit. Any suitable command system may be used. The command system may provide a user or operator at a surface with a tool for monitoring and indexing a drill bit in according to embodiments disclosed herein.

A plurality of sensors may be provided to the drill bit to monitor the condition and location of the drill bit and the cone assemblies. For example, an operator may monitor wear of cutters 123 located on drill bit 103 with a sensor 134 provided to monitor wear, as illustrated in FIG. 3. Based on the amount of wear of the cutters (i.e., if the cutters 123 are worn such that the cutters 123 are less effective at penetrating the formation), the operator may send a signal to index the cones 121. For example, if the indexable structure is hydraulically actuated a signal may be sent to, for example, open a valve to increase fluid flow to the indexing mechanism or a signal may be sent to increase fluid flow down hole. In some embodiments, once the indexable structures have been indexed to a desired location, a signal may be sent to the surface so that the indexing may be halted and drilling may be resumed. A location sensor may be provided to determine the depth of cut and which portion of the cones 121 is engaging the formation. A rotation sensor 132 may also be on a journal 131 or otherwise coupled to the drill bit 103 to monitor a position of at least one of the indexable structures (i.e. a cone or wheel). One or more sensors may be used with any of the above-described indexing mechanisms.

A few example embodiments have been described in detail; however, those skilled in the art will appreciate that modifications are possible without materially departing from the specific embodiments disclosed herein. For instance, indexing mechanisms may include a worm drive, other drive mechanisms, or other variations of the described embodiments. Such modifications are intended to be included within the scope of this disclosure. Any element described in relation to an embodiment herein may be combinable with any element of any other embodiment described herein.

In the claims, any means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means-plus-function or other functional claiming for any limitations of any of the claims herein, except for those in which the claim expressly uses the words 'means for' together with an associated function. Each addition, deletion, and modification to the embodiments that fall within the meaning and scope of the claims is to be embraced by the claims.

What is claimed is:

1. A drill bit comprising:

a bit body;

at least two cone assemblies mounted to the bit body, each cone assembly including a drive cylinder including a cone mounted thereon, each cone assembly including a plurality of cutting elements; and an indexing mechanism coupled to the bit body and configured to index the drive cylinders of the at least two cone assemblies to index the cones mounted thereon, and to lock at least one drive cylinder and the cone mounted thereon.

2. The drill bit of claim 1, the indexing mechanism including:

an indexing cylinder;

a gear coupled to a first end of the indexing cylinder; and a piston at a second end of the indexing cylinder.

3. The drill bit of claim 2, the indexing cylinder further including an indexing channel located on an outer surface thereof.

4. The drill bit of claim 3, further comprising an indexing pin coupled to an inner surface of the piston and configured to move along the indexing channel.

5. The drill bit of claim 2, further comprising a spring in a central chamber, the central chamber being formed by the indexing cylinder and the piston.

6. The drill bit of claim 2, the piston including a track on an outer surface of an end thereof.

7. The drill bit of claim 6, further comprising a locking mechanism that engages the track and is configured to move relative to the track to engage a corresponding cone.

8. A bit comprising a bit body;

at least two indexable structures, each indexable structure including a plurality of cutting elements; and an indexing mechanism on the bit body, the indexing mechanism engaging at least one of the at least two indexable structures, the indexing mechanism being configured to selectively rotate the at least one of the at least two indexable structures a discrete amount within a range of motion between 15 to 70 degrees.

9. The bit of claim 8, the indexable structures being configured to remain stationary with respect to the bit body while performing a cutting operation.

10. The bit of claim 8, the indexing mechanism being configured to lock the at least two indexable structures against rotation.

11. The bit of claim 8, further comprising at least one sensor coupled to the bit body and configured to monitor a rotational position of at least one of the indexable structures.

12. The bit of claim 8, at least one of the at least two indexable structures being a wheel or a cone.

13. The bit of claim 12, each of the at least two indexable structures being a wheel, and at least one of the wheels being a first wheel installed off-axis such that a diameter of the bit changes as the first wheel is indexed.

14. The bit of claim 8, further comprising at least one sensor configured to monitor wear of at least a portion of the plurality of cutting elements.

15. The bit of claim 8, a shape of a cutting end of at least one of the plurality of cutting elements being from the group consisting of a cylindrical shape, a conical shape, a concave surface terminating in an apex, a convex side surface terminating in an apex, a hyperbolic paraboloid shape, and a parabolic cylinder.

16. A method of drilling a wellbore, the method comprising:

providing fluid to a drill bit at a distal end of a drill string, the drill bit including at least two indexable structures, each indexable structure including a plurality of cutters, the drill bit including an indexing mechanism in a first position;

rotating the drill string and thereby drilling a formation;

moving the indexing mechanism an axial distance within a central chamber of the drill bit to a second position, wherein moving the indexing mechanism includes axially moving a piston of the indexing mechanism disposed in a piston chamber, wherein a first end of the piston is in the central chamber, thereby rotating a gear of the indexing mechanism;

rotating the at least two indexable structures in response to movement of the indexing mechanism; and locking the at least two indexable structures.

17. The method of claim 16, wherein moving the indexing mechanism is performed after the plurality of cutters have been determined to be in a worn state.

18. The method of claim 16, wherein rotating the at least two indexable structures includes engaging at least one indexable structure with a gear of the indexing mechanism.

19. The method of claim 16, wherein moving the indexing mechanism includes changing a fluid flow rate to the drill bit.

* * * * *